US007278436B2

(12) United States Patent
Gale et al.

(10) Patent No.: US 7,278,436 B2
(45) Date of Patent: Oct. 9, 2007

(54) ADJUSTABLE WALKER

(75) Inventors: Bradley Gale, Columbus, IN (US); Mike Ienna, Rochester, NY (US)

(73) Assignee: Cosco Management, Inc., Wilmington, DE (US)

( * ) Notice: Subject to any disclaimer, the term of this patent is extended or adjusted under 35 U.S.C. 154(b) by 471 days.

(21) Appl. No.: 10/831,821

(22) Filed: Apr. 26, 2004

(65) Prior Publication Data

US 2005/0236025 A1 Oct. 27, 2005

(51) Int. Cl.
*A45B 9/00* (2006.01)
*A61H 3/00* (2006.01)

(52) U.S. Cl. ..... 135/74; 135/67

(58) Field of Classification Search ..... 135/67, 135/74, 75, 77; 248/406.1, 408; 482/908; 403/109.2, 109.3
See application file for complete search history.

(56) References Cited

U.S. PATENT DOCUMENTS 4,056,115 A * 11/1977 Thomas ..... 135/67
4,869,279 A * 9/1989 Hedges ..... 135/67
4,974,760 A 12/1990 Miller
5,012,963 A 5/1991 Rosenbaum
5,188,139 A * 2/1993 Garelick ..... 135/67
5,433,235 A * 7/1995 Miric et al. ..... 135/67
5,529,425 A * 6/1996 Spies et al. ..... 403/322.4
5,755,245 A * 5/1998 Van Helvoort ..... 135/70
6,453,921 B1 * 9/2002 Rost ..... 135/67
6,651,684 B2 * 11/2003 Spitzer ..... 135/78
6,886,575 B2 5/2005 Diamond

FOREIGN PATENT DOCUMENTS

WO WO0181148 11/2001

* cited by examiner

*Primary Examiner*—David Dunn
*Assistant Examiner*—Danielle Jackson
(74) *Attorney, Agent, or Firm*—Barnes & Thornburg LLP

(57) ABSTRACT

A walker includes a frame and two frame supports. The frame supports provide arms and legs and are coupled to the frame to support the arms in elevated positions above ground underlying the frame.

45 Claims, 15 Drawing Sheets

ADJUSTABLE WALKER

BACKGROUND

The present disclosure relates to ambulatory aids, and in particular to walkers. More particularly, the present disclosure relates to collapsible and height-adjustable walkers.

SUMMARY

A walker includes an elevated frame comprising two upright sleeves and a stretcher located between the sleeves. The walker also includes frame supports and each frame support extends through a channel formed in one of the sleeves to elevate the frame.

Each frame support includes an arm supported for rotation in one of the sleeves between use and storage positions and a companion leg coupled to that arm to rotate therewith relative to the sleeve receiving the arm. Thus, by rotating the arm relative to the sleeve about an axis of rotation, the companion leg can also be moved relative to the frame between expanded use and collapsed storage positions along with handgrips provided on the arms. An arm-rotation adjustor is provided for each arm to lock an arm and its companion leg in selected positions relative to the elevated frame so as to establish, for example, use and storage configurations of the walker.

In illustrative embodiments, each rotatable arm is mated telescopically with its companion leg so that the elevation of hand grips provided on the arms can be raised or lowered by adjusting the position of each arm on its companion leg without interfering with rotary movement of each arm about its axis of rotation. An arm-height adjustor is provided for each arm to lock the arms in one of several positions on the companion legs so as to establish the elevation of the hand grips to a height desired by the user.

Also in illustrative embodiments, each leg is Y-shaped and includes a post that extends upwardly into a channel formed in one of the sleeves to mate with a companion arm that extends downwardly into the same channel. The post is formed to include a series of lock pin-receiving apertures configured to receive a lock pin provided in the arm-height adjustor and mounted in the companion arm to set the height of the handgrip on the companion arm. Each leg also includes an inverted V-shaped post foundation coupled to a lower portion of the post and adapted to engage ground underlying the walker frame.

Features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 8 is an elevation view (taken generally along line 8-8 of FIG. 6) showing placement of a horizontally extending right anchor pin included in the right arm in an arcuate guide slot formed in the right leg (as shown in FIG. 9) to limit up-and-down movement of the right arm relative to the walker frame and showing projection of a spring-loaded anti-rotation pin included in the right-side arm-rotation adjustor through an upper pin hole formed in the right arm and a pin-receiving aperture formed in a right arm receiver included in the walker frame to block rotation of the right arm relative to the walker frame about a pivot axis;

FIG. 9 is a perspective view of the right-side arm-rotation adjustor of FIG. 8 with a portion broken away to show the right anchor pin located at a first end of the arcuate guide slot formed in the right leg;

FIG. 10 is an elevation view similar to FIG. 8, with portions broken away, showing manual movement of an actuator button included in the right-side arm-rotation adjustor to disengage the spring-loaded anti-rotation pin from the pin-receiving aperture formed in the right arm receiver included in the walker frame so that the right arm is free to rotate about an axis relative to the walker frame and showing partial (e.g., about halfway) rotation of the right arm relative to the walker frame toward the folded, storage position shown in FIG. 7;

FIG. 11 is a perspective view of the right-side arm-rotation adjustor of FIG. 10 with a portion broken away to show the right anchor pin located in the "middle" of the arcuate guide slot formed in the right leg;

FIG. 12 is an elevation view similar to FIGS. 8 and 10 showing rotation of the right arm relative to the walker frame to assume the folded, storage position shown in FIG. 7;

FIG. 13 is a perspective view of the right-side arm-rotation adjustor of FIG. 12 with a portion broken away to show movement of the right anchor pin to an opposite end of the arcuate guide slot formed in the right leg following rotation of the right arm to the folded, storage position;

FIG. 14 is a sectional view taken along line 14-14 of FIG. 6 showing telescopic reception of the right arm in the right leg and showing projection of a spring-loaded lock pin included in the right-side arm-height adjustor through apertures formed in the right arm and right leg to block up-and-down movement of the right arm relative to the right leg to limit the height of the right frame support;

FIG. 15 is a sectional view similar to FIG. 12 showing manual movement of an actuator button included in the right-side arm-height adjustor to begin to disengage the spring-loaded lock pin from the aperture formed in the right leg so that the right leg is free to move up or down relative to the right arm;

FIG. 16 is a sectional view similar to FIGS. 14 and 15 showing disengagement of the lock pin from the pin-receiving aperture formed in the right leg and upward telescopic movement of the right leg relative to the right arm;

FIG. 22 is an exploded perspective view of an arm-rotation adjustor associated with the right side of an adult walker;

FIG. 23 is an elevation view of the arm-rotation adjustor of FIG. 22, with portions broken away, that is similar in orientation to the view shown in FIG. 8, showing rotation of the right arm relative to the walker frame to assume the use position shown, for example, in FIG. 6;

FIG. 24 is a sectional view taken along line 24-24 of FIG. 23;

FIG. 25 is an elevation view similar to FIG. 10 showing manual movement of an actuator button to free the right arm to rotate about an axis relative to the walker frame.

FIG. 26 is an elevation view similar to FIG. 12 showing rotation of the right arm relative to the walker frame to assume the folded, storage position shown, for example, in FIG. 7;

FIG. 27 is an exploded perspective view of an arm-height adjustor associated with the right side of an adult walker;

FIG. 28 is a perspective view of the actuator button of FIG. 27 from another point of view;

FIG. 29 is a sectional view similar to FIG. 14 showing telescopic reception of the right arm in the right leg and showing projection of a spring-loaded lock pin included in the right-side arm-height adjustor through apertures formed in the right arm and right leg to block up-and-down movement of the right arm relative to the right leg to limit the height of the right frame support;

FIG. 30 is a sectional view similar to FIG. 15 showing manual movement of an actuator button included in the right-side arm-height adjustor to begin to disengage the spring-loaded lock pin from the aperture formed in the right leg so that the right leg is free to move up or down relative to the right arm;

FIG. 31 is a sectional view similar to FIG. 16 showing disengagement of the lock pin from the pin-receiving aperture formed in the right leg and upward telescopic movement of the right leg relative to the right arm;

DETAILED DESCRIPTION

Figure 1:
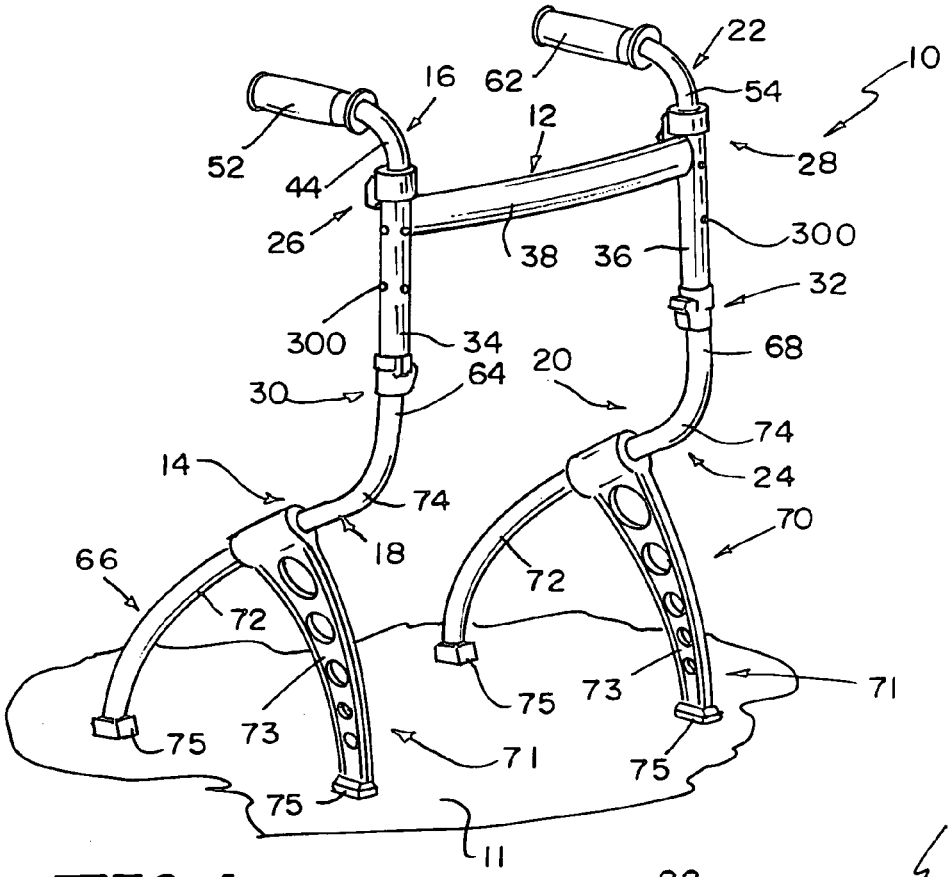
FIG. 1 is a front perspective view of an adult walker in accordance with the present disclosure showing an H-shaped walker frame, a left frame support providing a left-hand grip for a walker user and including a left arm extending above the frame and a left leg extending below the frame, and a right frame support providing a right-hand grip for a walker user and including a right arm extending above the frame and a right leg extending below the frame.
Figure 2:
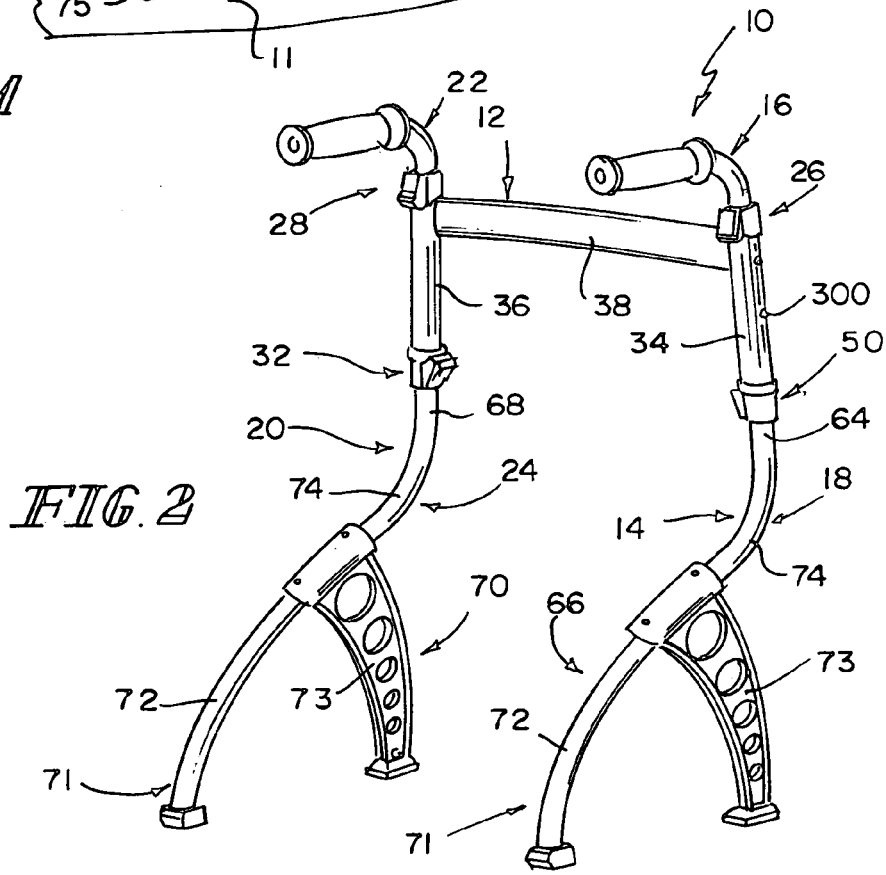
FIG. 2 is a rear perspective view of the walker of FIG. 1 showing a left-side arm-rotation adjustor at the junction between the left arm and the H-shaped walker frame, a left-side arm-height adjustor at the junction between the left leg and the walker frame, a right-side arm-rotation adjustor at the junction between the right arm and the walker frame, and a right-side arm-height adjustor at a junction between the right leg and the walker frame.
Figure 3:
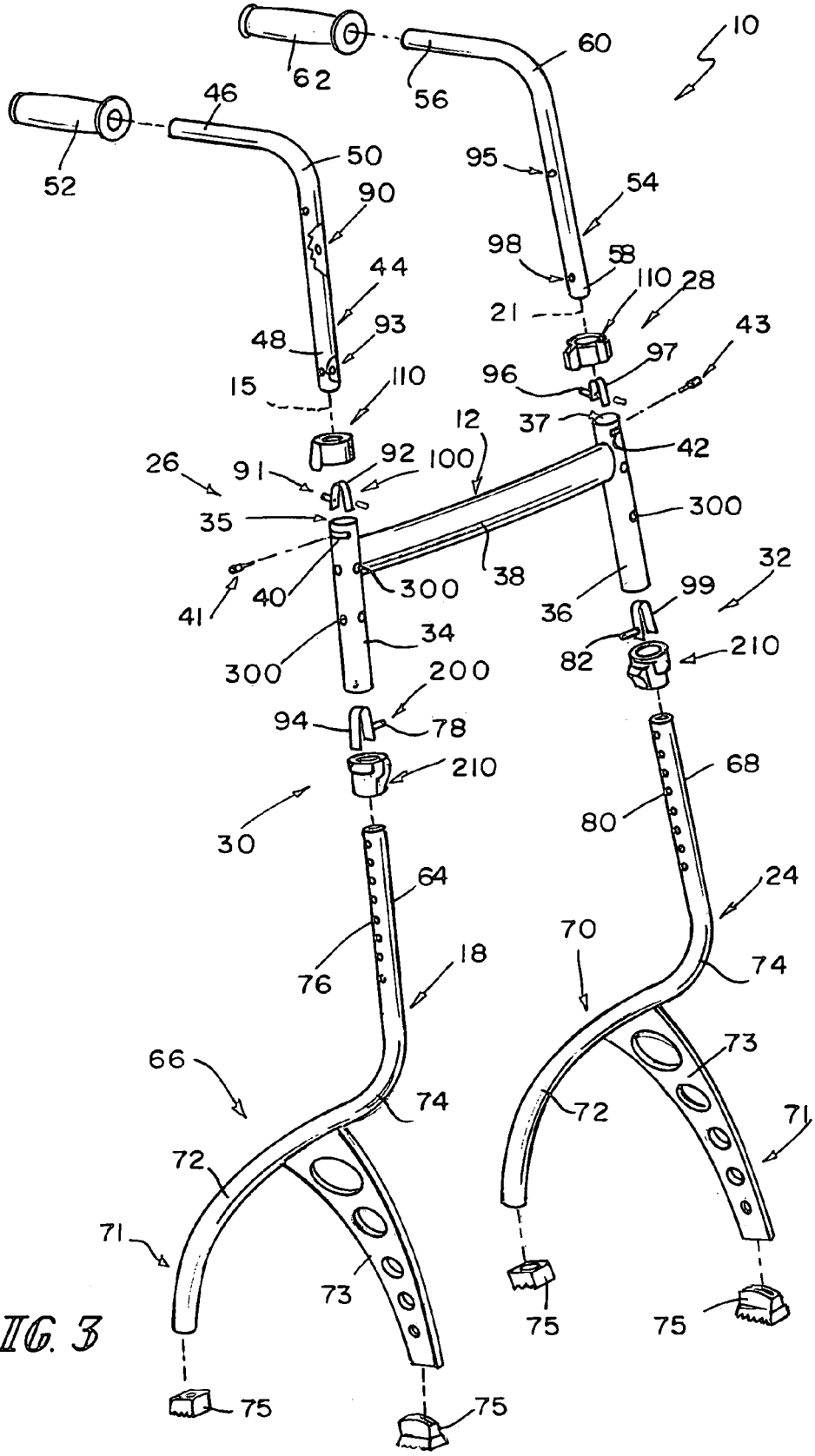
FIG. 3 is an exploded perspective assembly view of the walker of FIGS. 1 and 2 showing the left and right arms above the H-shaped walker frame and the left and right legs below the walker frame along with two arm-rotation adjustors and two arm-height adjustors.
Figure 4:
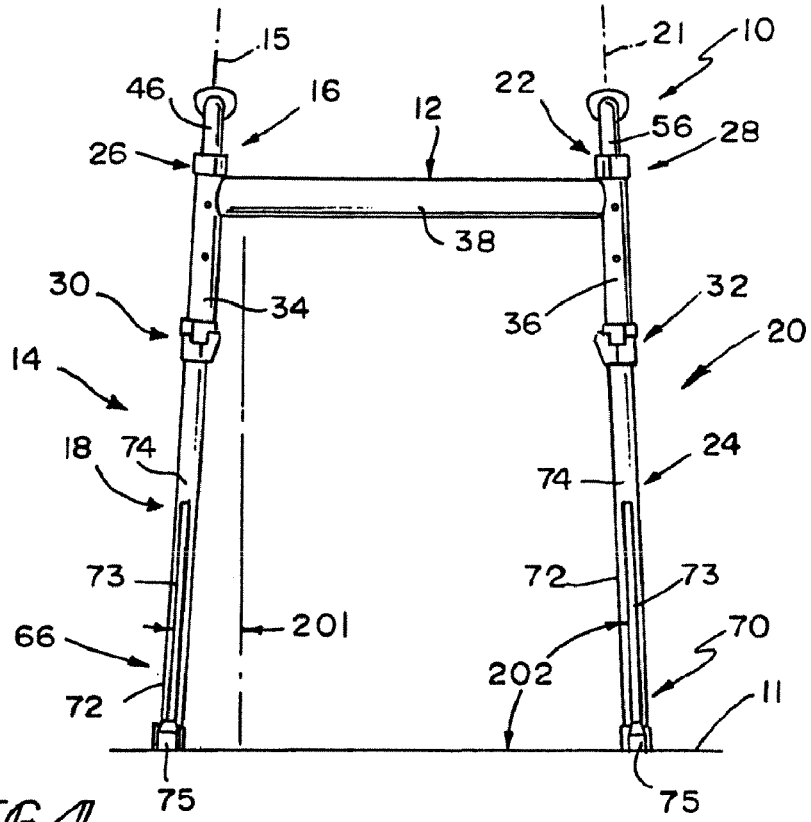
FIG. 4 is a front elevation view of the walker of FIG. 1.
Figure 5:
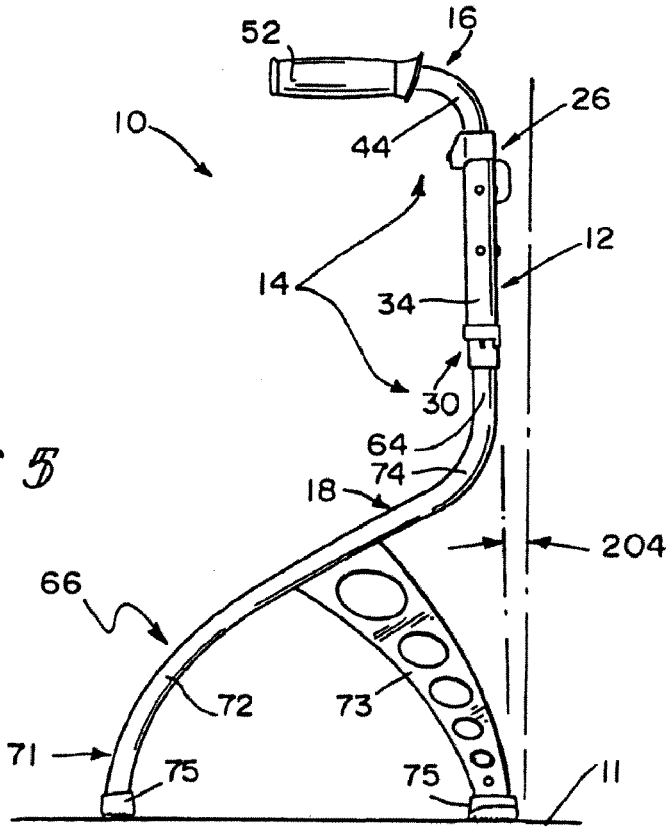
FIG. 5 is a side elevation view of the walker of FIG. 1.

A walker 10 includes a walker frame 12, a first frame support 14 including a first arm 16 and first leg 18, and a second frame support 20 including a second arm 22 and a second leg 24 (as shown, for example, in FIGS. 1-3). First and second frame supports 14, 20 are coupled to walker frame 12 to support walker frame 12 in an elevated position above ground 11 underlying walker frame 12 as suggested in FIG. 1.

Walker 10 is configured to be collapsed easily at the option of the user for storage or transit. First frame support 14 can be rotated about an axis of rotation 15 between a "use" position shown in FIGS. 1, 2, 4-6, 8, and 9 and a "folded, storage" position shown in FIGS. 7 and 12 using a first arm-rotation adjustor 26 in a manner suggested, for example, in FIGS. 8-13. Similarly, second frame support 20 can be rotated about an axis of rotation 21 between a use position shown in FIG. 6 and a folded, storage position shown in FIG. 7 using a second arm-rotation adjustor 28. One style of arm-rotation adjustor is shown in FIGS. 8-13, while another style of arm-rotation adjustor is shown in FIGS. 22-26.

Figure 16:
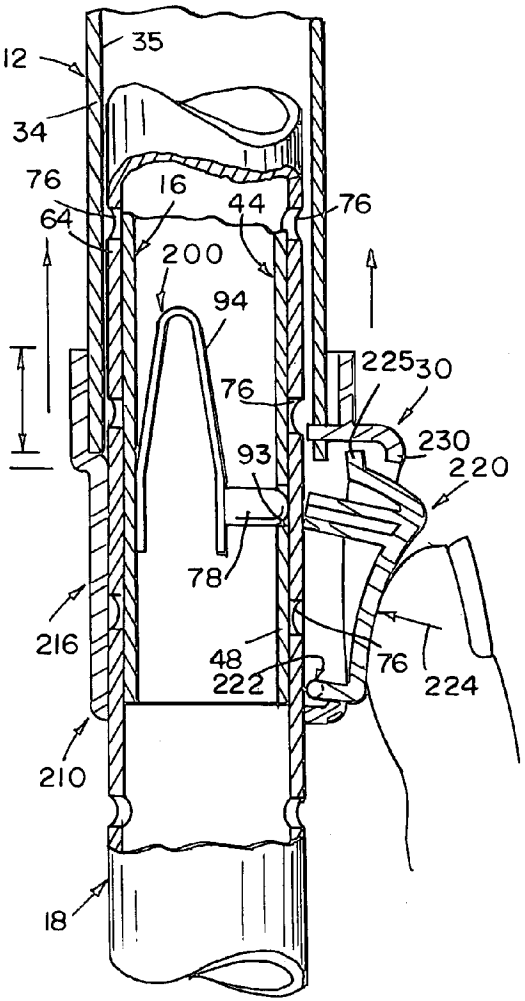
Figure 15:
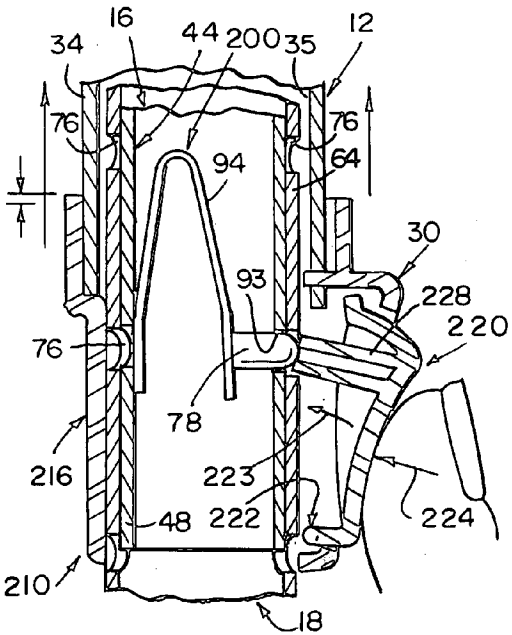
Figure 14:
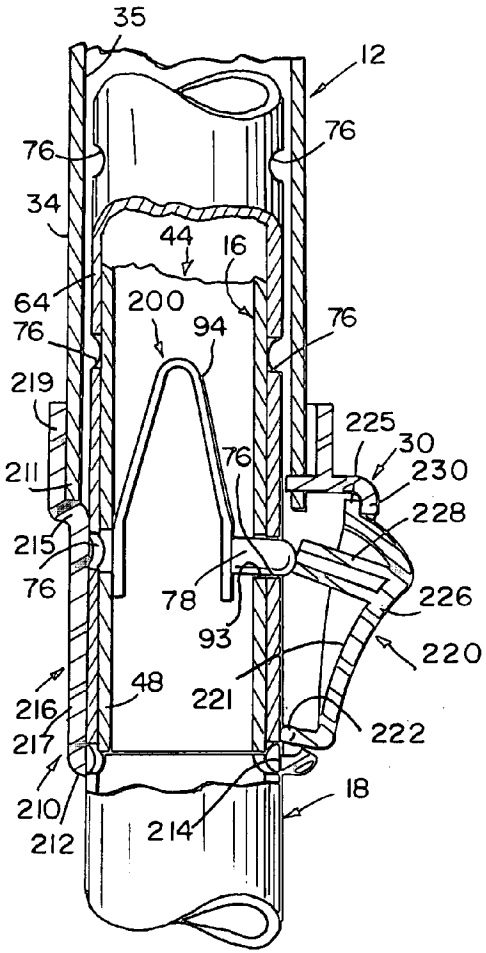
Figure 17:
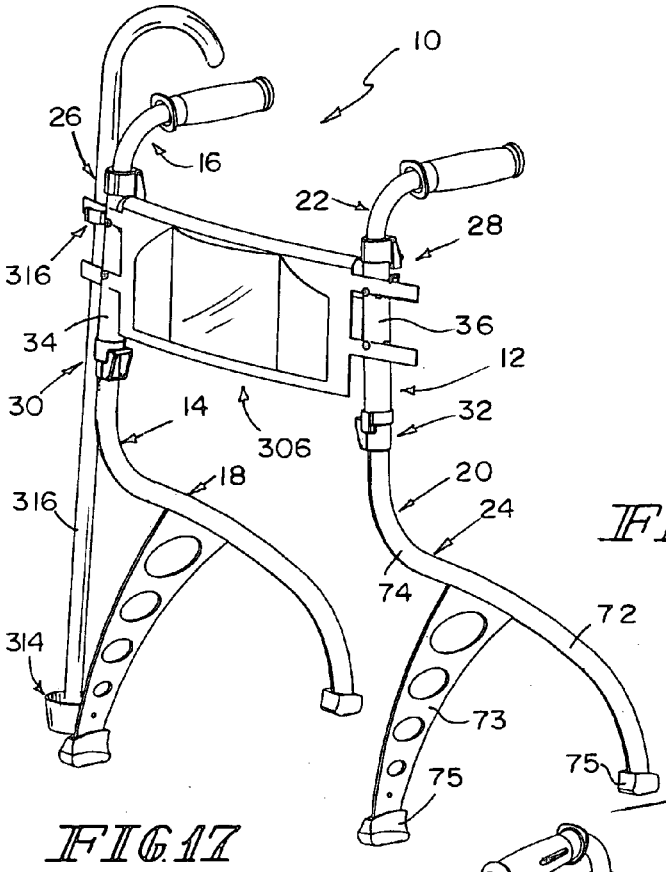
FIG. 17 is a front perspective view similar to FIG. 1 showing a pouch accessory mounted on the walker frame.

Walker 10 is configured to adapt easily to users of various heights at the option of the user. A first arm-height adjustor 30 linking first arm 16 and first leg 18 can be operated in a manner suggested, for example, in FIGS. 14-16 to raise or lower first arm 16 (and one side of walker frame 12) relative to first leg 18 and underlying ground 11. Similarly, a second arm-height adjustor 32 linking second arm 22 and second leg 24 can be operated to raise and lower second arm 22 (and an opposite side of walker frame 12) relative to second leg 24 and underlying ground 11. One style of arm-height adjustor is shown in FIGS. 14-16, while another style of arm-height adjustor is shown in FIGS. 27-33.

Walker frame 12 includes upright first and second arm receivers (e.g. sleeves 34, 36) and a stretcher 38 as shown, for example, in FIGS. 1-3. Stretcher 38 is arranged to interconnect first and second sleeves 34, 36 to maintain sleeves 34, 36 in spaced-apart relation to one another. In an illustrative embodiment, stretcher 38 is an elongated tubular member having a first end coupled to first sleeve 34 and a second end coupled to second sleeve 36. First frame support 14 is mounted for rotation about axis of rotation 15 in a first support receiver channel 35 formed in first sleeve 34. Second frame support 20 is mounted for rotation about axis of rotation 21 in a second support receiver channel 37 formed in second sleeve 36. In the illustrated embodiment, tubular stock is used to form sleeves 34, 36 and stretcher 38 and that stock is assembled to define a somewhat "H-shaped" walker frame 12 as shown best in FIG. 4.

A pin guide slot 40 is formed in first sleeve 34 and a pin guide slot 42 is formed in second sleeve 36 as suggested in FIG. 3. Pin guide slot 40 as an arcuate shape is adapted to receive an anchor pin 41 included in first arm 16 therein to limit rotation of first frame and support 14 about axis of rotation 15 in first sleeve 34 of walker frame 12 as suggested in FIGS. 9, 11, and 13. Likewise, pin guide slot 42 has an arcuate shape and is adapted to receive an anchor pin 41 included in second arm 22 therein to limit rotation of second frame support 20 about axis of rotation 21 in second sleeve 36 of walker frame 12.

As shown in FIG. 3, first arm member 44 of first arm 16 includes a handle portion 46, a mount portion 48, and an elbow 50 interconnecting handle and mount portions 46, 48. First arm member 44 is L-shaped in the illustrated embodiment. A "right-hand" grip 52 is adapted to be coupled to handle portion 46. Mount portion 48 of first arm member 44 is adapted to extend downwardly into first support receiver channel 35 formed in first sleeve 34 and be coupled to upwardly extending first leg 18.

A second arm member 54 of second arm 22 includes a handle portion 56, a mount portion 58, and an elbow 60 interconnecting handle and mount portions 56, 58 as also shown in FIG. 3. Second arm member 54 is L-shaped in the illustrated embodiment. A "left-hand" grip 62 is adapted to be coupled to handle portion 56. Mount portion 58 of second arm member 54 is adapted to extend downwardly into first support receiver channel 37 formed in second sleeve 36 and be coupled to upwardly extending second leg 24.

Figures 8, 9, 10, 11:
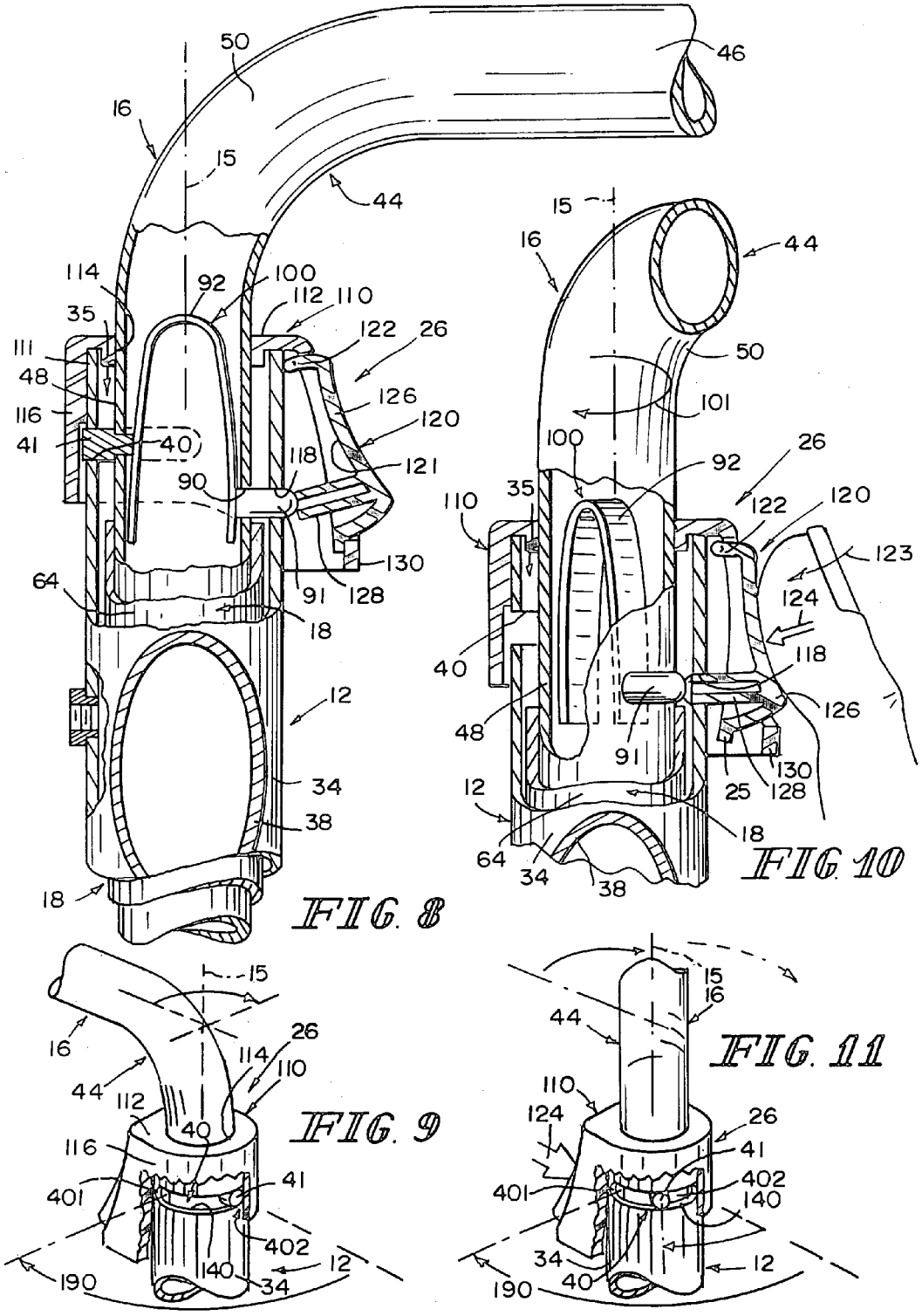
FIGS. 8-16 illustrate structure and operation of arm-rotation and arm-height adjustors in accordance with a first embodiment of the disclosure.
Figure 12:
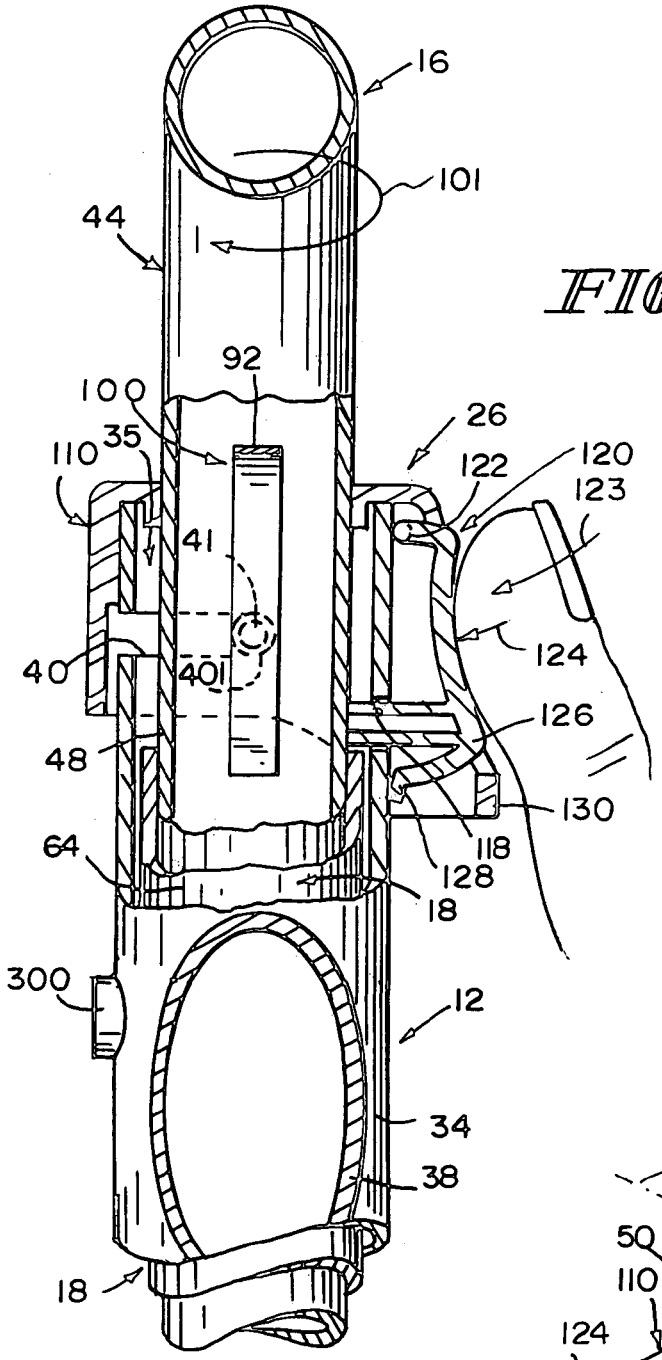

An upper portion of mount portion 48 of first arm member 44 is formed to include at least one upper pin hole 90 as shown, for example, in FIGS. 3 and 8. Upper pin hole 90 is sized to receive an anti-rotation pin 91 adapted to mount in mount portion 48 and biased by a pin-biasing spring 92 to project radially outwardly through upper pin hole 90. Anti-rotation pin 91 is included in first frame support 14 and can move to an extended position to link first arm 16 to first sleeve 34 to block rotation of first arm 16 relative to first sleeve 34 about pivot axis 15 to lock first frame support 14 in the use position as shown in FIG. 8 or in the storage position as shown in FIG. 12. As shown in FIG. 10, anti-rotation pin 91 can move to a retracted position away from first sleeve 34 to allow rotation of first arm 16 relative to first sleeve 34 about pivot axis 15 between the use and storage positions.

A lower portion of mount portion 48 of first arm member 44 is formed to include at least one lower pin hole 93 as shown, for example, in FIGS. 3 and 14-16. Lower pin hole 93 is sized to receive a lock pin 78 adapted to mount in mount portion 48 and biased by pin-biasing spring 94 to project radially outwardly through lower pin hole 93. Lock pin 78 can move to an extended position to link first arm 16 to first leg 18 as shown in FIG. 14 to block "extensible" (e.g., telescoping) movement of first leg 18 relative to walker frame 12 and first arm 16 along pivot axis 15. Lock pin 78 can move to a retracted position away from first leg 18 as suggested in FIGS. 15 and 16 to allow extensible (e.g., telescoping) movement of first leg 18 relative to walker frame 12 and first arm 16 along pivot axis 15.

Figure 6:
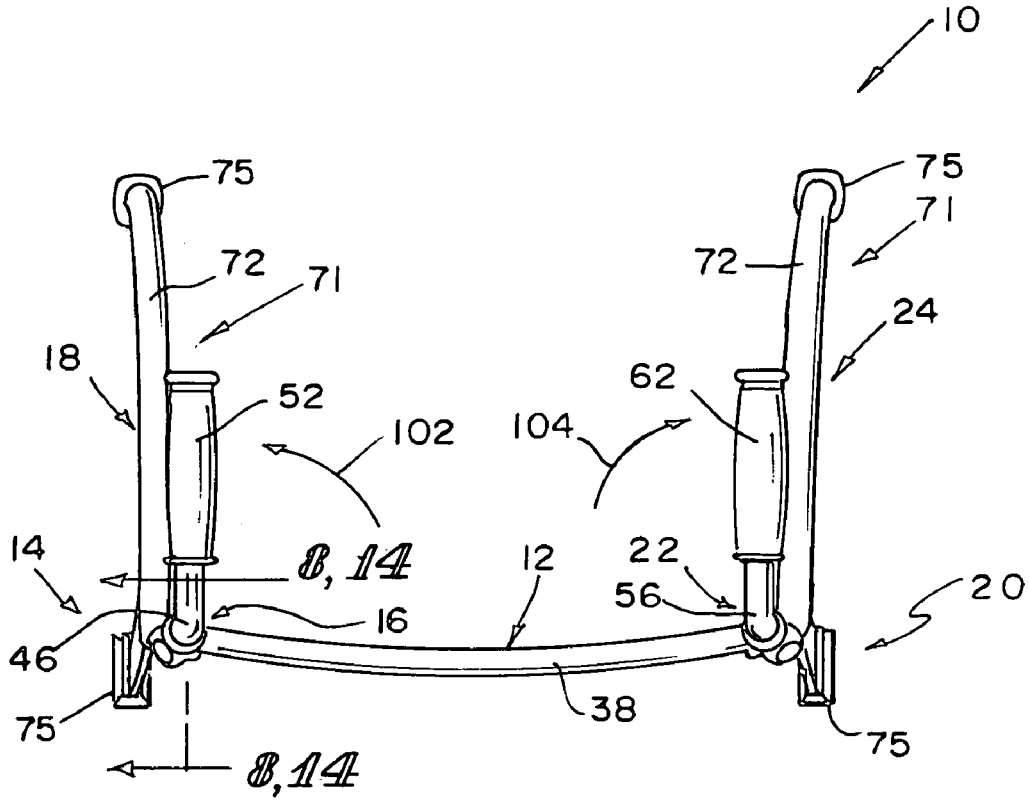
FIG. 6 is a top plan view of the walker of FIG. 1.
Figure 7:
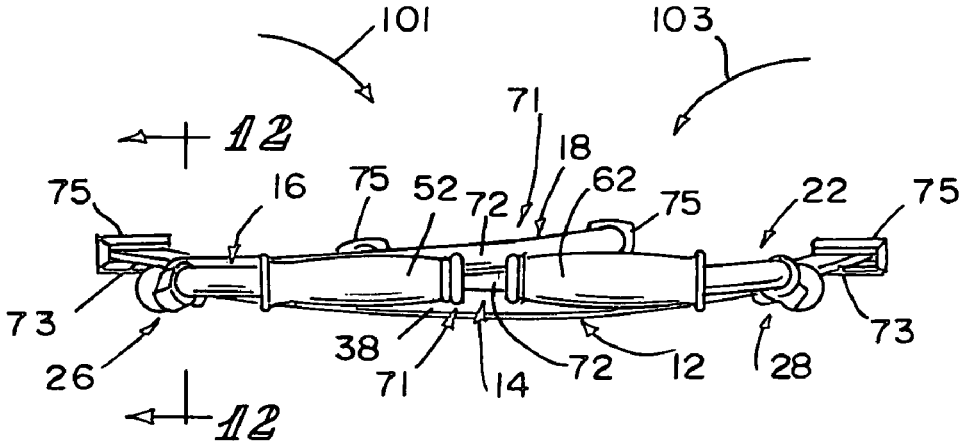
FIG. 7 is a view similar to FIG. 6 showing clockwise rotation of the right frame support about a pivot axis from a use position shown in FIG. 6 to a folded, storage position alongside the walker frame and showing counterclockwise rotation of the left frame support about a pivot axis from a use position shown in FIG. 6 to a folded, storage position alongside the walker frame.

An upper portion of mount portion 58 of second arm member 54 is formed to include at least one upper pin hole 95 as shown, for example, in FIG. 3. Upper pin hole 95 is sized to receive an anti-rotation pin 96 adapted to mount in mount portion 58 and biased by a pin-biasing spring 97 to project radially outwardly through upper pin hole 95. Anti-rotation pin 96 is included in second frame support 20 and can move to an extended position to link second arm 22 to second sleeve 36 to block rotation of second arm 22 relative to second sleeve 36 about pivot axis 21 to lock second frame support 20 in the use position as shown in FIG. 6 or in the storage position as shown in FIG. 7. Anti-rotation pin 96 can move to a retracted position away from second sleeve 36 to allow rotation of second arm 22 relative to second sleeve 36 about pivot axis 21.

A lower portion of mount portion 58 of second arm member 54 is formed to include at least one lower pin hole 98 as shown, for example, in FIG. 3. Lower pin hole 98 is sized to receive a lock pin 82 adapted to mount in mount portion 58 and biased by pin-biasing spring 99 to project radially outwardly through lower pin hole 98. Lock pin 78 can move to an extended position to link second arm 22 to second leg 24 to block "extensible" (e.g., telescoping) movement of second leg 24 relative to walker frame 12 and second arm 22 along pivot axis 21. Lock pin 78 can move to a retracted position away from second leg 24 to allow extensible (e.g., telescoping) movement of second leg 24 relative to walker frame 12 and second arm 22 along pivot axis 21.

First leg 18 includes a post 64 adapted to extend upwardly into first support receiver channel 35 formed in first sleeve 34 and mate with downwardly extending mount portion 48 of first arm member 44 as suggested in FIGS. 3 and 14. In the illustrated embodiment, post 64 is received telescopically in mount portion 48. First leg 18 also includes a post foundation 66 coupled to a lower portion of post 64 and adapted to rest on ground 11 underlying first leg 18. Likewise, second leg 24 includes a post 68 adapted to extend upwardly into second support receiver channel 37 formed in second sleeve 36 and mate with downwardly extending mount portion 56 of second arm member 54 as suggested in FIG. 3. Second leg 24 also includes a post foundation 70 coupled to a lower portion of post 68 and adapted to rest on ground 11 underlying second leg 24.

As suggested in FIG. 3, each post foundation 66, 70 includes an inverted V-shaped member 71 comprising a base 72 and a post stabilizer 73 and also includes a leg elbow 74 interconnecting base 72 and companion post 64 or 68. An upper portion of each base 72 is coupled to its companion elbow 74. An upper portion of each post stabilizer 73 is coupled to its companion base 72. As suggested in FIGS. 1-4, each post stabilizer 73 is arranged to underlie its companion post 64 or 68. In the illustrated embodiment, each leg 18, 24 is Y-shaped.

V-shaped members 71 of post foundations 66, 70 are arranged to lie in spaced-apart relation to one another (as suggested in FIGS. 1, 2, 4, and 6) when first and second mount portions 48, 58 are rotated away from one another in opposite rotary directions 102, 104 about axes of rotation 15, 21 to assume the use positions. Also, V-shaped members 71 are arranged to lie in side-by-side overlapping relation (as suggested in FIG. 7) to cause bases 72 to cross and lie in a space below stretcher 38 between post stabilizers 73 when first and second mount portions 48, 58 are rotated toward one another in opposite rotary directions 101, 103 to assume the storage positions. Feet 75 are coupled to terminal ends of bases 72 and post stabilizers 73.

An upper portion of post 64 is formed to include a series of spaced-apart lock pin-receiving apertures 76 as shown best in FIG. 3. These apertures 76 are sized to receive a lock pin 78 adapted to mount in mount portion 48 of first arm member 44 to vary the mounting location of mount portion 48 on post 64 as suggested in FIGS. 14-16 so as to set the "elevation" of right-hand grip 52 above ground 11. Likewise, an upper portion of post 68 is formed to include a series of spaced-apart lock pin-receiving apertures 80 as also shown in FIG. 3. These apertures 76 are sized to receive a lock pin 82 adapted to mount in mount portion 58 of second arm member 54 to vary the mounting location of mount portion 58 on post 68 to set the elevation of left-hand grip 62 above ground 11. It is within the scope of this disclosure to provide suitable "receivers" for lock pins 78, 82 on posts 64, 68 other than the apertures shown in the illustrated embodiment.

First frame support 14 includes a first arm 16 supported on the upright first sleeve 34 for rotation about axis of rotation 15 between a storage position alongside stretcher 38 as shown in FIG. 7 and a use position at a selected angle to stretcher 38 as shown in FIG. 6. First arm 16 is arranged to extend away from first sleeve 34 to provide a grip portion adapted to be gripped by a first hand of a user. First frame support 14 further includes first leg 18 coupled to first arm 16 to rotate therewith relative to first sleeve 34 about axis of rotation 15 and extend below first sleeve 34 and adapted to engage ground 11 underlying walker frame 12.

First sleeve 34 is formed to include pin guide slot 40 and first arm 16 includes a mount portion 48 extending into first support receiver channel 35 and an anchor pin 41 coupled to mount portion 48. Anchor pin 41 is arranged to extend into pin guide slot 40 for movement therein during rotation of first arm 16 relative to first sleeve 34 about axis of rotation 15 to block removal of mount portion 48 from first support receiver channel 35 formed in first sleeve 34.

Figure 13:
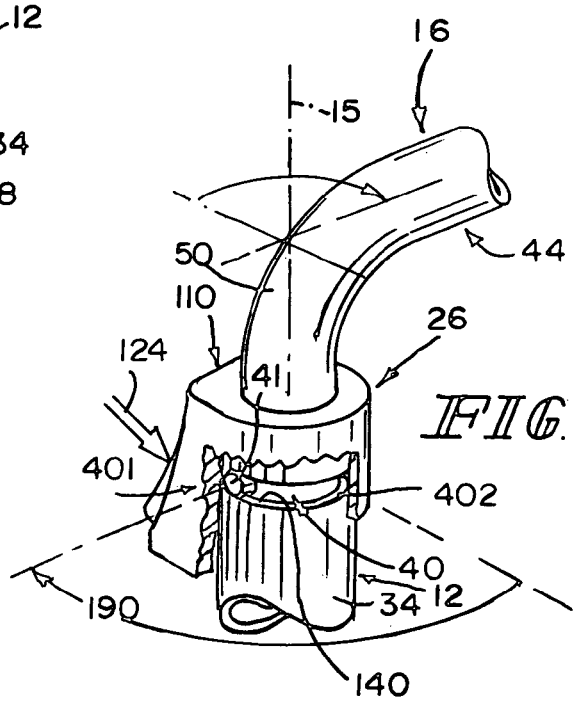

Pin guide slot 40 is shown in more detail in FIGS. 9, 11, and 13 and is similar to pin guide slot 42. One end of pin guide slot 40 defines a closed-position stop 401 arranged to engage anchor pin 41 upon rotation of first arm 16 about axis of rotation 15 in a first rotary direction 101 to assume the storage position to block further rotation of first arm 16 in first rotary direction 101. An opposite end of pin guide slot 40 defines an opened-position stop 402 arranged to engage anchor pin 41 upon rotation of first arm 16 about axis of rotation 15 in a second rotary direction 102 opposite to first rotary direction 101 to assume the use position to block further rotation of first arm 16 in second rotary direction 102. As suggested in FIGS. 9, 11, and 13, border 140 providing an edge of pin guide slot 40 extends between closed-position stop 401 and opened-position stop 402 to define an arc subtending a central angle 190 of about 90° having a vertex along axis of rotation 15.

Walker frame 12 further includes a button mount coupled to an upper end 111 of first sleeve 34 as suggested in FIGS. 1, 8, and 9. In the embodiment of FIGS. 1-13, an upper end cap 110 provides the button mount and includes a top wall 112 formed to include an arm receiver aperture 114 receiving mount portion 48 therein and a skirt 116. Skirt 116 depends from top wall 112 to locate a portion of upper end 111 of first sleeve 34 providing pin guide slot 40 between skirt 116 and mount portion 48. Skirt 116 covers pin guide slot 40 and anchor pin 41 extending into pin guide slot 40.

First sleeve 34 includes an upper end 111 defining an opening into first support receiver channel 35. Stretcher 38 lies in spaced-apart relation to upper end 111 of first sleeve 34. Pin guide slot 40 is formed in first sleeve 34 to lie between upper end 111 and stretcher 38.

First sleeve 34 is also formed to include a pin-receiving aperture 118 as shown in FIG. 8. First arm 16 is formed to include an upper pin hole 90. First frame support 14 further includes an anti-rotation pin 91 mounted for movement in upper pin hole 90 between an extended position (shown in FIG. 8) projecting into pin-receiving aperture 118 and upper pin hole 90 to link first arm 16 to first sleeve 34 to block rotation of first arm 16 relative to first sleeve 34 about axis of rotation 15. First frame support 14 further includes a pin-biasing spring 92 associated with first arm 16 and arranged to urge anti-rotation pin 91 to the extended position upon alignment of upper pin hole 90 of first arm 16 in confronting relation to pin-receiving aperture 118 of first sleeve 34 as shown in FIG. 8. Anchor pin 41, anti-rotation pin 91, and pin-biasing spring 92 cooperate to define arm retainer 100 as shown, for example, in FIGS. 1, 8, 10, and 12.

Walker frame 12 further includes an actuator button 120 mounted for pivotable movement about a pivot axis 122 on a button mount (e.g. upper end cap 110). Actuator button 120 is arranged to pivot in direction 123 about pivot axis 122 in response to application of a force 124 (see FIGS. 10 and 11) to intercept anti-rotation pin 91 as shown, for example, in FIG. 8 and move anti-rotation pin 91 as shown, for example, in FIGS. 9 and 10, to disengage pin-receiving aperture 118 formed in first sleeve 34. As suggested in FIGS. 8, 10, and 12, pin guide slot 40 is formed in first sleeve 34 to lie between upper end 111 and pin-receiving aperture 118. Arm retainer 100, upper end cap 118, and actuator button 120 cooperate to define first arm-rotation adjustor 26.

Actuator button 120 includes a finger plate 126 coupled to upper end cap 110 using any suitable pivot support (not shown) and a pin mover 128 cantilevered to an underside 121 of finger plate 126. A plate stop 130 is provided below finger plate 126 as shown, for example, in FIGS. 8 and 10 to engage a lip 25 to limit movement of finger plate 126 away from first sleeve 34 as shown in FIG. 8 without disrupting movement of finger plate 126 in direction 123 as shown in FIGS. 10 and 12. Actuator button 120 and upper end cap 110 cooperate, for example, to provide a lock actuator included in walker frame 12 to move anti-rotation pin 91 from the extended position to the retracted position to free first leg 18 for rotary movement relative to walker frame 12 and first arm 16 about axis of rotation 15. A similar lock actuator is provided for second arm 22 and second leg 24.

Walker frame 12 further includes a button mount (e.g. lower end cap 210) coupled to a lower end 211 of first sleeve 34 as suggested in FIGS. 14-16. Lower end 211 defines an opening into first support receiver channel 35. Lower end cap 210 includes a bottom wall 212 formed to include a leg receiver aperture 214 receiving post 64 therein and a skirt 216 appended to bottom wall 12. Skirt 216 includes a lower stage 217 surrounding post 64, an annular flange 215 abutting a downwardly facing annular edge of lower end 211 and extending radially outwardly from an upper portion of lower stage 217, and an upper stage 219 surrounding lower end 211 of first sleeve 34 and connecting to annular flange 215 as shown, for example, in FIGS. 14-16.

Post 64 of leg 18 is formed to include a series of vertically spaced-apart, lock pin-receiving apertures 76 as shown in FIGS. 3 and 14-16. First arm 16 is formed to include lower pin hole 93. First frame support 14 further includes a lock pin 78 mounted for movement in lower pin hole 93 between an extended position (shown in FIG. 14) projecting into a selected one of the lock pin-receiving apertures 76 and lower pin hole 93 to link first arm 16 to first leg 18 to block telescoping movement of first leg 18 relative to walker frame 12 and first arm 16 along axis of rotation 15. First frame support 14 further includes a pin-biasing spring 94 associated with first arm 16 and arranged to urge lock pin 78 normally to the extended position upon alignment of lower pin hole 93 of first arm 16 in confronting relation to a selected lock pin-receiving aperture 76 of post 64 of leg 18 as shown in FIG. 14. Lock pin 78 and pin-biasing spring 94 cooperate to define a height retainer 200 as shown, for example, in FIGS. 1 and 14-16.

Walker frame 12 further includes an actuator button 220 mounted for pivotable movement about a pivot axis 222 on a button mount (e.g. lower end cap 210). Actuator button 220 is arranged to pivot in direction 223 about pivot axis 222 in response to application of a force 224 (see FIGS. 15 and 16) to intercept and move lock pin 78 from the extended position to a retracted position to discharge lock pin 78 from lock pin-receiving aperture 76 to free first leg 18 for telescoping movement relative to walker frame 12 and first arm 16 along axis of rotation.

Actuator button 220 includes a finger plate 226 coupled to lower end cap 210 using any suitable pivot support (not shown) and a pin mover 228 cantilevered to an underside 221 of finger plate 226. A plate stop 230 is provided above finger plate 226 as shown, for example, in FIG. 14, to engage a lip 225 to limit movement of finger plate 226 away from first sleeve 34 without disrupting movement of finger plate 226 in direction 223 as shown in FIGS. 15 and 16. Actuator button 220 and lower end cap 210 cooperate, for example, to provide a lock actuator included in walker frame 12 to move lock pin 78 from the extended position to the retracted position to free first leg 18 for telescoping movement relative to walker frame 12 and first arm 16 about axis of rotation 15. A similar lock actuator is provided for second arm 22 and second leg 24.

In use, walker 10 is "opened" and arranged to provide ambulatory assistance to a user as suggested in FIGS. 1-6. In the illustrated embodiment, each frame support 14, 20 is arranged to lie at an acute angle 201 with respect to the vertical and at an acute angle 202 with respect to the horizontal as suggested in FIG. 4. Also, each sleeve 34, 36 of walker frame 12 is arranged to lie at an acute angle 204 with respect to the vertical as suggested in FIG. 5. When "closed," walker 10 is collapsed as shown in FIG. 7 for convenient storage and easy transit.

To close walker 10, first arm 16 is rotated about axis of rotation 15 as suggested in FIGS. 8-13. First arm 16 is shown in an opened position in FIGS. 10 and 11, and a closed position in FIGS. 12 and 13. Leg 18 is coupled to first arm 16 to rotate therewith. Second arm 22 can be closed in a similar manner.

To elevate walker 10, first leg 18 is unlocked and moved relative to first arm 16 as suggested in FIGS. 14-16. Second leg 24 can be moved in a similar manner.

Auxiliary features for walker 10 are shown, for example, in FIGS. 17-21. Each sleeve 34, 36 of walker frame 12 carries one or more fastener receivers 300 as suggested in FIGS. 1, 3, and 18. These receivers 300 are mounted in holes or recesses 302 formed in sleeves 34, 36 and adapted to receive mating fasteners 304. Fasteners 304 are mated with fastener receivers 300 to retain an accessory in place on walker frame 12. See, for example, pouch accessory 306 in FIGS. 17 and 19, tray 308 in FIG. 20, and console 310 in FIG. 21.

Figure 19:
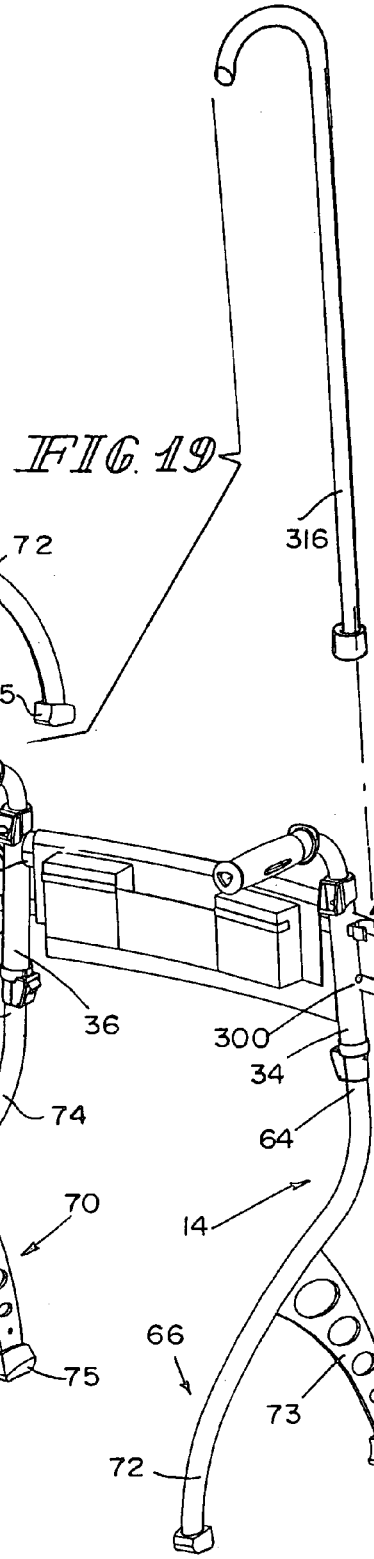
FIG. 19 is a rear perspective view of the walker showing a cane grip on the walker frame and a cane receiver cup on a right leg stabilizer coupled to the right leg and suggesting cooperation of the grip and cup to retain a cane in a transport position on the right side of the walker in the manner shown in FIG. 17.
Figure 18:
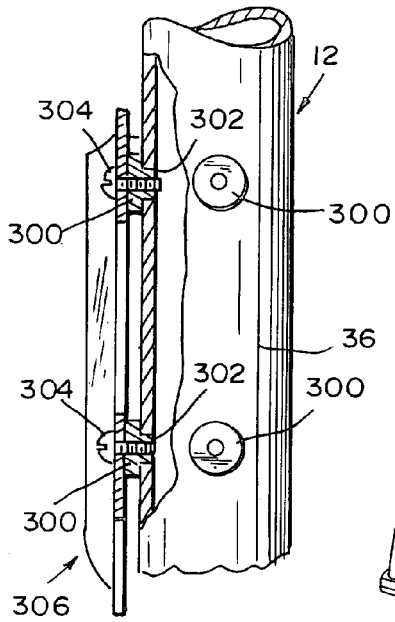
FIG. 18 is a side elevation of a portion of the walker frame and the mounted pouch accessory showing use of fasteners coupled to fastener-receiving inserts embedded in the arm receivers included in the walker frame to retain the pouch accessory in a mounted position on the walker frame.
Figure 20:
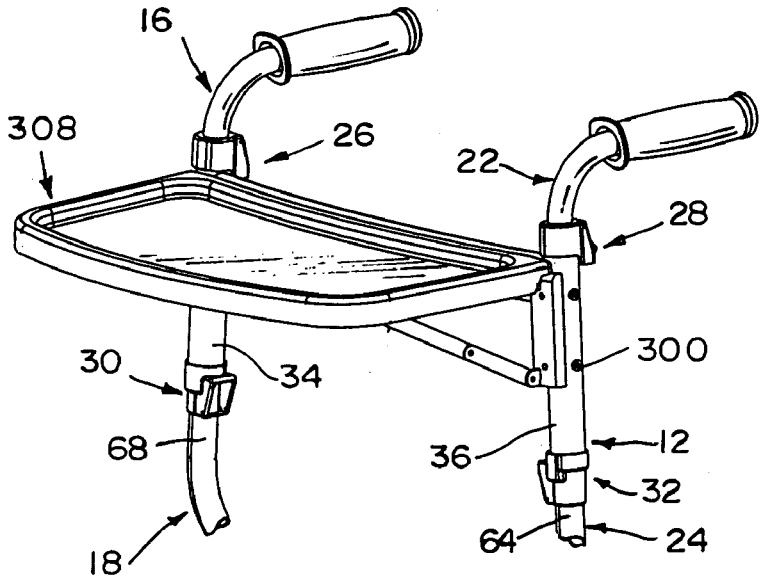
FIG. 20 is a partial perspective view similar to FIG. 17 showing a tray mounted on the walker frame using the fastener-receiver inserts embedded in the walker frame.
Figure 21:
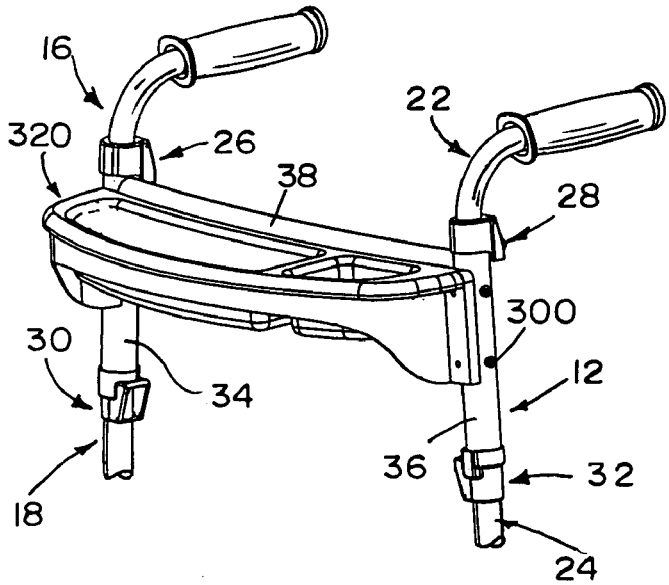
FIG. 21 is a view similar to FIG. 20 showing a console mounted on the walker frame using the fastener-receiver inserts embedded in the walker frame.

A cane grip 312 is shown on walker frame 12 in FIG. 19. A cane receiver cup 314 is coupled to post stabilizer 73 as suggested in FIG. 19. Grip 312 and cup 314 cooperate to retain a cane 316 in a transport position on the right side of walker 10 in the manner shown in FIG. 17.

A second embodiment of an arm-rotation adjustor in accordance with this disclosure is illustrated in FIGS. 22-26. This arm-rotation adjustor functions in a manner similar to arm-rotation adjustor 26 described above in connection with FIGS. 1-13. The arm-rotation adjustor illustrated in FIGS. 22-26 is configured to facilitate manufacture and assembly of an adult walker.

Figure 22:
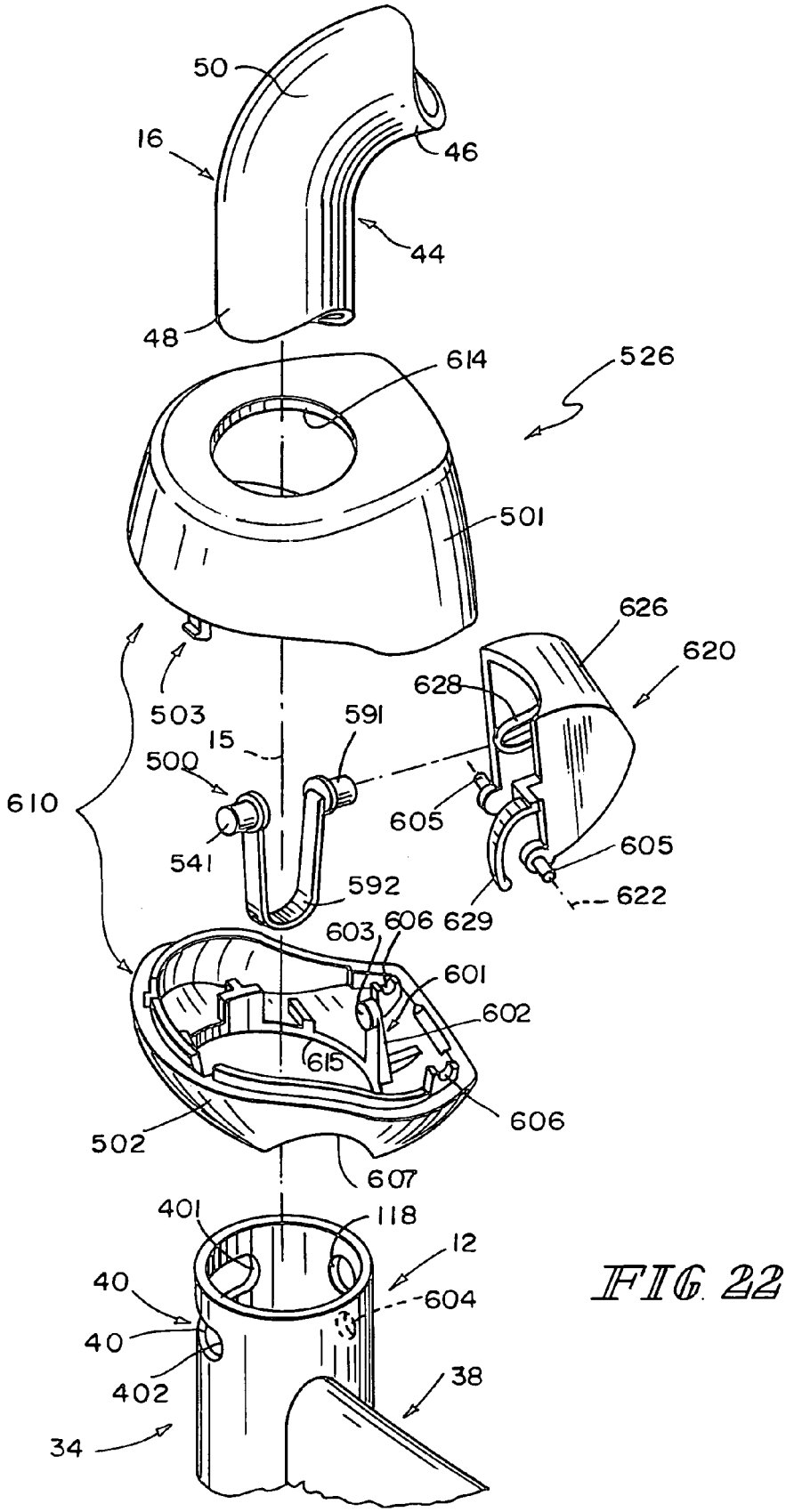
FIGS. 22-31 illustrate structure and operation of arm-rotation and arm-height adjustors in accordance with a second embodiment of the disclosure.

First and second frame supports 14 and 20 are each modified in accordance with this second embodiment to include an arm retainer 500 comprising an anchor pin 541, an anti-rotation pin 591, and a pin-biasing spring 592 as shown in FIGS. 22. Walker frame 12 is modified in accordance with this second embodiment to include, for each of frame supports 14 and 20, an actuator button 620 and an upper end cap 610 providing a button mount for actuator button 620. Arm retainer 500, upper end cap 610, and actuator button 620 cooperate to define a first arm-rotation adjustor 526 for first frame support 14 as shown, for example, in FIGS. 22-26. (A similar arm-rotation adjustor is provided for second frame support 20). Actuator button 620 is mounted to upper end cap 610 to pivot about pivot axis 622 in the manner shown, for example, in FIG. 25 during operation of first arm-rotation adjustor 526.

Figure 24:
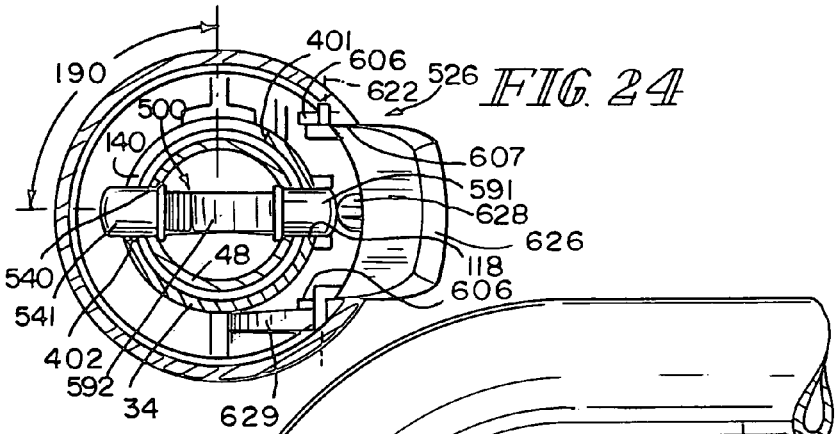

Arm retainer 500 is located in mount portion 48 of first arm member 44 of first arm 16 as suggested in FIG. 24. Pin guide slot 40 formed in first sleeve 34 of walker frame 12 is adapted to receive anchor pin 41 therein to limit rotation of first frame support 14 about axis of rotation 15 in first sleeve 34 of walker frame 12 as suggested in FIGS. 22-26. Anchor pin 541 extends through an aperture 540 formed in mount portion 48 and then into pin guide slot 40 as suggested in FIGS. 23 and 24. Pin-biasing spring 592 is configured to urge anti-rotation pin 591 normally to project radially outwardly through upper pin hole 90 formed in mount portion 48 and into pin-receiving aperture 118 formed in first sleeve 34 of walker frame 12 upon alignment of upper pin hole 90 and pin-receiving aperture 118 as suggested in FIG. 23. Anchor pin 41 and anti-rotation pin 591 illustratively have the same size, shape, and location relative to pin-biasing spring 592 so that arm retainer 500 can be oriented easily when installed in mount portion 48 to cause one of the pins to serve as anchor pin 541 and the other of the pins to serve as anti-rotation pin 591.

Actuator button 620 is mounted for pivotable movement about pivot axis 622 on a button mount (e.g., upper end cap 610). Actuator button 620 is arranged to pivot in direction 625 about pivot axis 622 in response to application of force 124 (see FIGS. 25 and 26) to intercept anti-rotation pin 591 as shown, for example, in FIG. 23 and move anti-rotation pin 591 as shown, for example, in FIG. 24, to disengage pin-receiving aperture 118 formed in first sleeve 34 to free first arm 16 for rotation about axis of rotation 15 relative to first sleeve 34.

Figure 23:
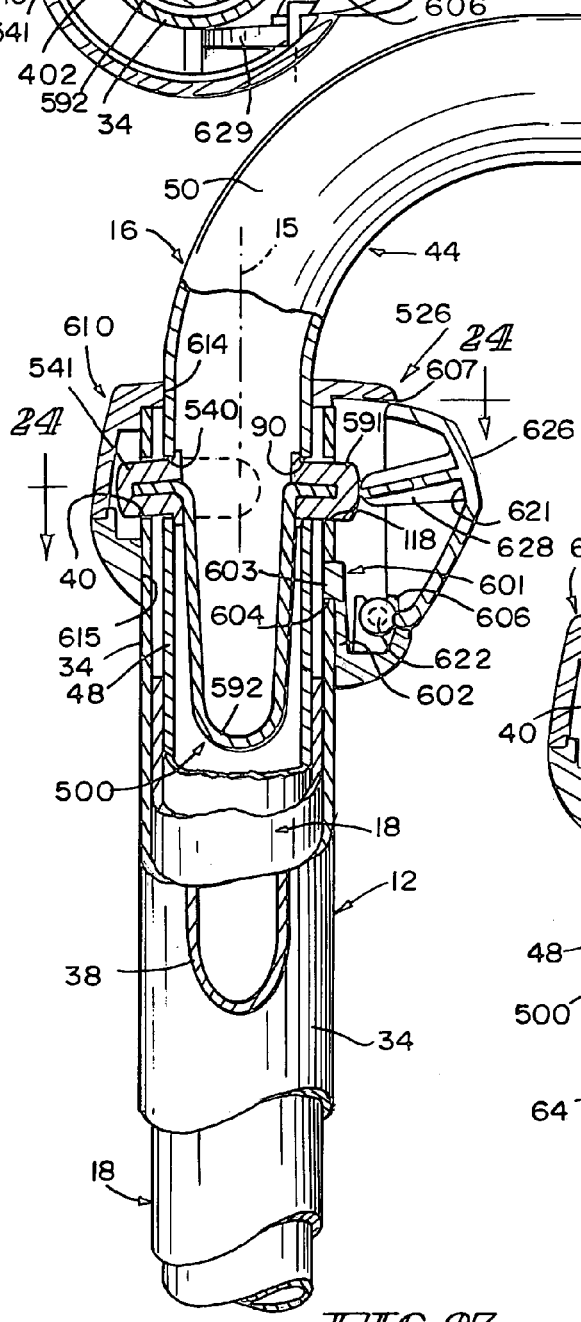

Upper end cap 610 includes a top shell 501 adapted to be coupled to a bottom shell 502 using connector 503 (or any suitable connector) as suggested in FIGS. 22 and 23. Top shell 501 includes a top wall 512 formed to include an arm receiver aperture 614 receiving mount portion 48 therein. Top shell 501 also includes a skirt 516 depending from top wall 512 to locate a portion of the upper end of first sleeve 34 providing pin guide slot 40 between skirt 516 and mount portion 48. Bottom shell 502 is formed to include an arm receiver aperture 615 receiving first sleeve 34 and mount portion 48 therein. A retainer 601 including an upstanding post 602 appended to bottom shell 502 along an inner edge defining arm receiver aperture 615 and a pin 603 appended to post 602 is provided to retain bottom shell 502 in a fixed position on first sleeve 34 upon engagement of pin 603 in a pin-receiving aperture 604 formed in first sleeve 34 as suggested in FIGS. 22 and 23. Curved edge 607 of bottom shell 502 is arranged to mate with stretcher 38 of walker frame 12 to help support upper end cap 610 in a fixed position relative to walker frame 12.

Figure 25:
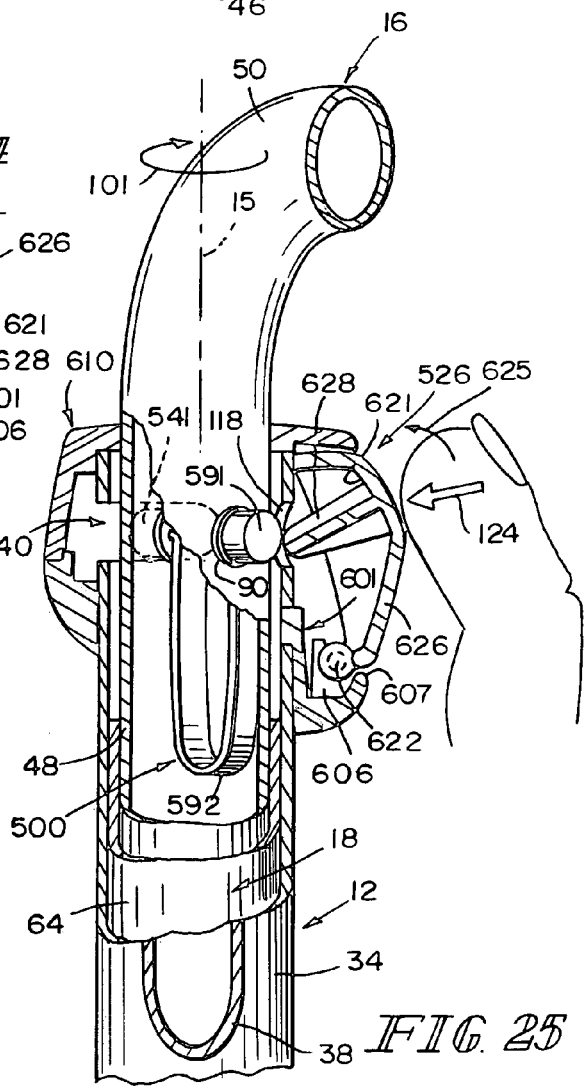
Figure 26:
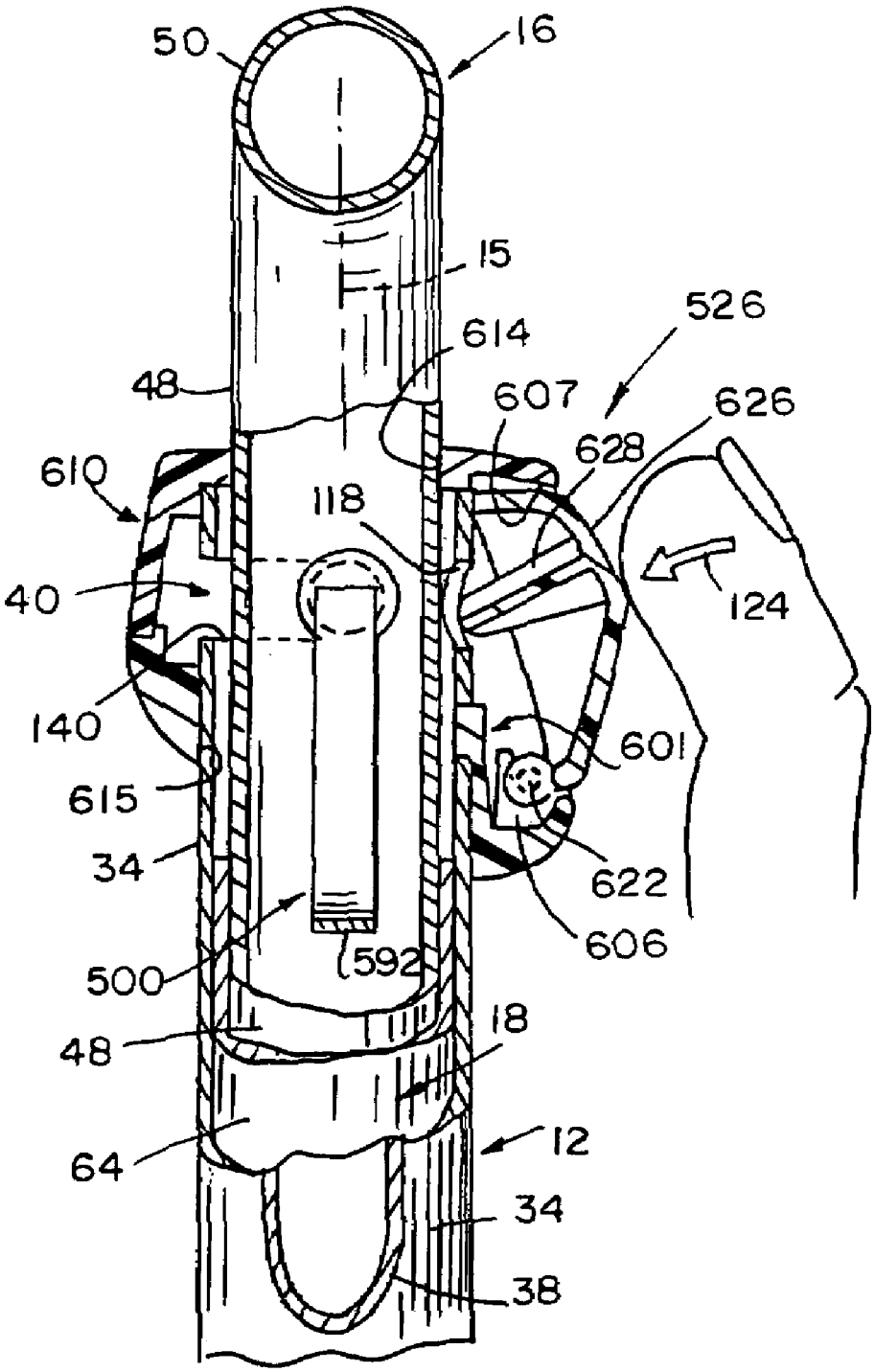

Actuator button 620 includes a finger plate 626 coupled to bottom shell 502 of upper end cap 610 using, for example, pivot supports 605 and a pin mover 628 cantilevered to an underside 621 of finger plate 626. Actuator button 620 also includes a curved return spring 629 made of a resilient material and arranged to engage bottom shell 502 to urge finger plate 626 normally to a "ready" position shown in FIGS. 23 and 24 and an aperture 607 formed in upper end cap 610 after it is depressed as shown in FIGS. 25 and 26 and then released. Pivot supports 605 comprise two pins arranged to extend in opposite directions to mate with pivot mounts 606 formed in bottom shell 502 to support actuator button 620 for pivotable movement about pivot axis 622. Return spring 629 is cantilevered and arranged to lie in offset relation to a central portion of finger plate 626 to lie adjacent to one of pivot mounts 606 as suggested in FIG. 24.

A second embodiment of an arm-height adjustor in accordance with this disclosure is illustrated in FIGS. 27-33. This arm-height adjustor functions in a manner similar to arm-height adjustor 30 described above in connection with FIGS. 1-7 and 14-16. The arm-height adjustor illustrated in FIGS. 27-33 is configured to facilitate manufacture and assembly of an adult walker.

Walker frame 12 is modified in accordance with this second embodiment to include, for each of frame supports 14 and 20, an actuator button 720 and a lower end cap 710 providing a button mount for actuator button 720. Actuator button 720 is mounted to lower end cap 710 to move laterally toward and away from a height retainer 700 comprising lock pin 78 and pin-biasing spring 94 in the manner shown, for example, in FIGS. 29, 30, and 31 during operation of a first arm-height adjustor 730. Height retainer 700, lower end cap 710, and actuator button 720 cooperate to define first arm-height adjustor 730 as shown, for example, in FIGS. 27-33.

Figure 27:
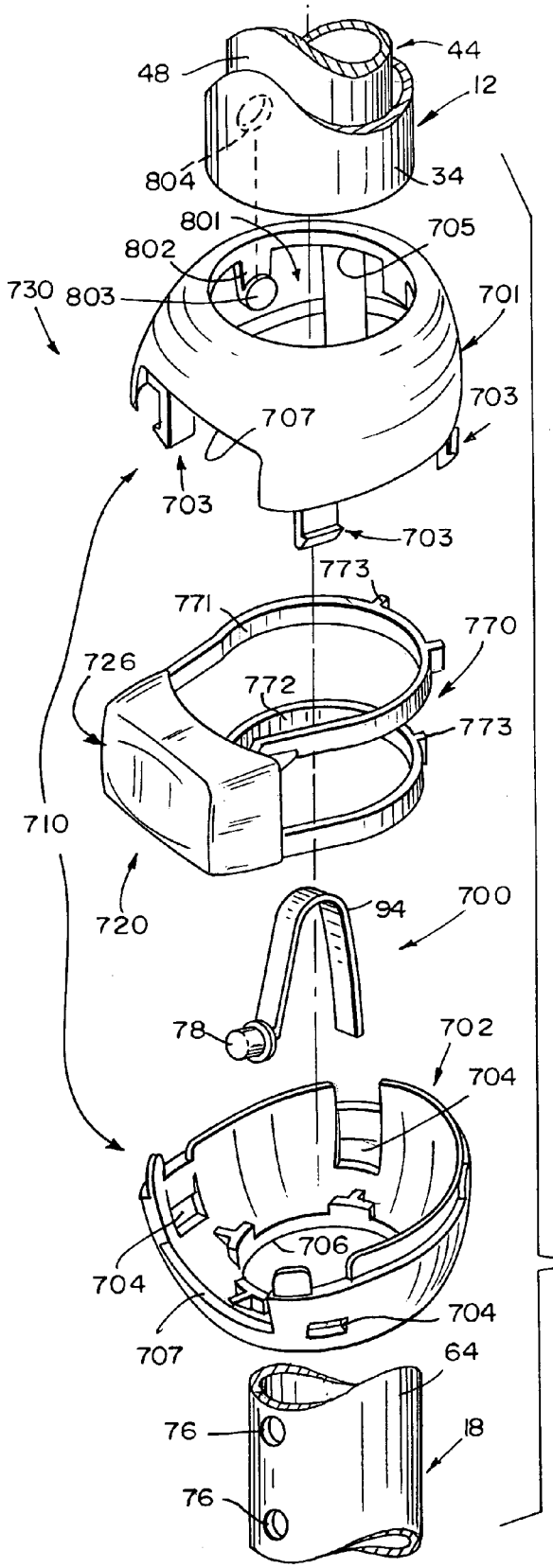
Figure 29:
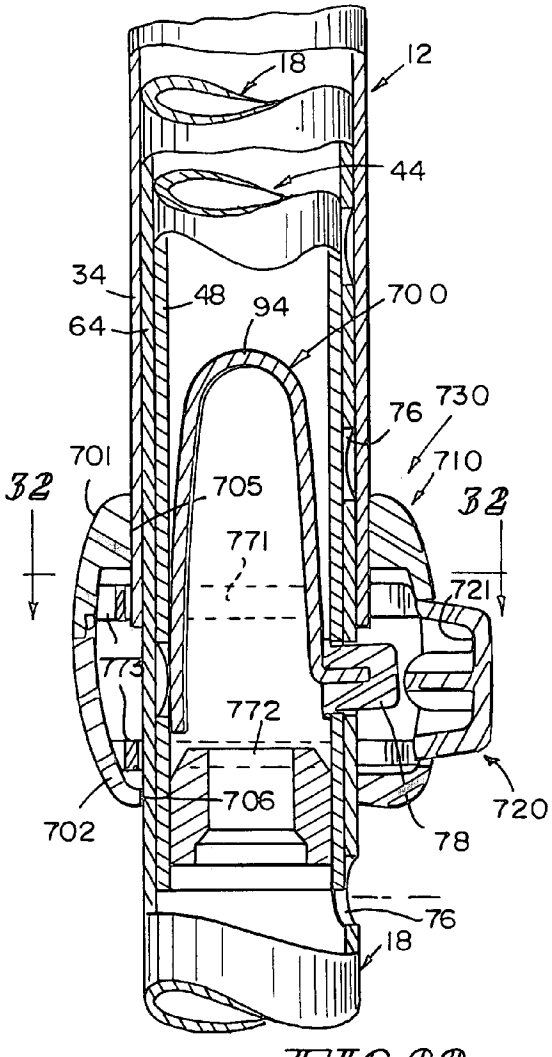
Figure 32:
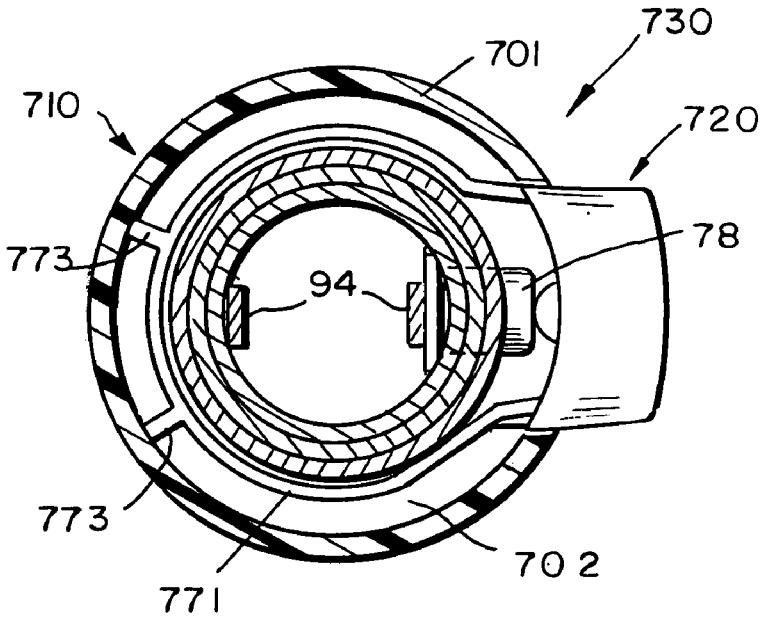
FIG. 32 is a sectional view taken along line 32-32 of FIG. 29.
Figure 33:
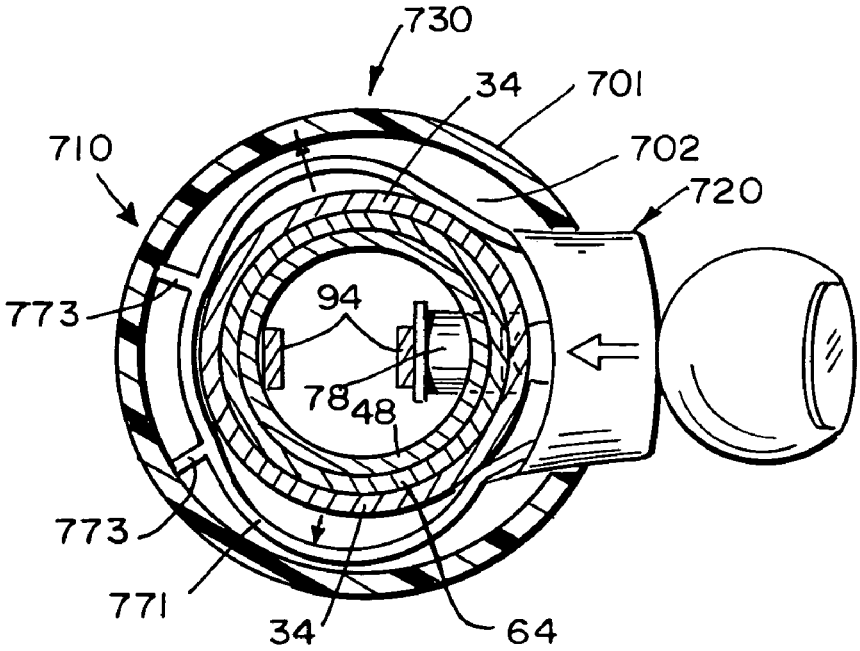
FIG. 33 is a sectional view taken along line 33-33 of FIG. 31.

Lower end cap 710 includes a top shell 701 adapted to be coupled to a bottom shell 702 using connectors 703 (or any suitable connectors) to mate with receivers 704 as suggested in FIGS. 27 and 29. Top shell 701 is formed to include an aperture 705 sized to receive first sleeve 34, post 64, and mount portion 48 therein as suggested in FIGS. 27 and 29. Bottom shell 702 is formed to include an aperture 706 sized to receive post 64 and mount portion 48 therein as suggested in FIGS. 27 and 29.

A retainer 801 including a depending post 802 and a pin 803 appended to post 802 is provided to retain top shell 701 (and thus bottom shell 702) in a fixed position on first sleeve 34 of walker frame 12 upon engagement of pin 803 in a pin-receiving aperture 804 formed in first sleeve 34 as suggested in FIG. 27. Post 802 is appended to top shell 701 along an edge-defining aperture 705.

Actuator button includes a finger plate 726, a pin mover 728 cantilevered to an interior side 721 of finger plate 726 and means 770 for mounting finger plate 726 for lateral movement in an aperture 707 formed in lower end cap 710 toward and away from height retainer 700 as suggested in FIGS. 27, 28, 29, and 32. Actuator button 720 and lower end cap 710 cooperate, for example, to provide a lock actuator included in walker frame 12 to move lock pin 78 from an extended position shown in FIG. 29 to a retracted position shown in FIG. 31 to free first leg 18 for telescoping movement relative to walker frame 12 and first arm 16 about axis of rotation 15.

Figure 28:
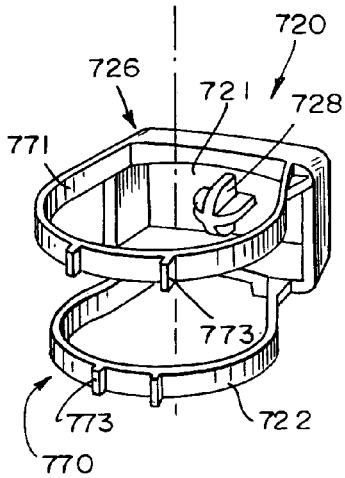
Figure 31:
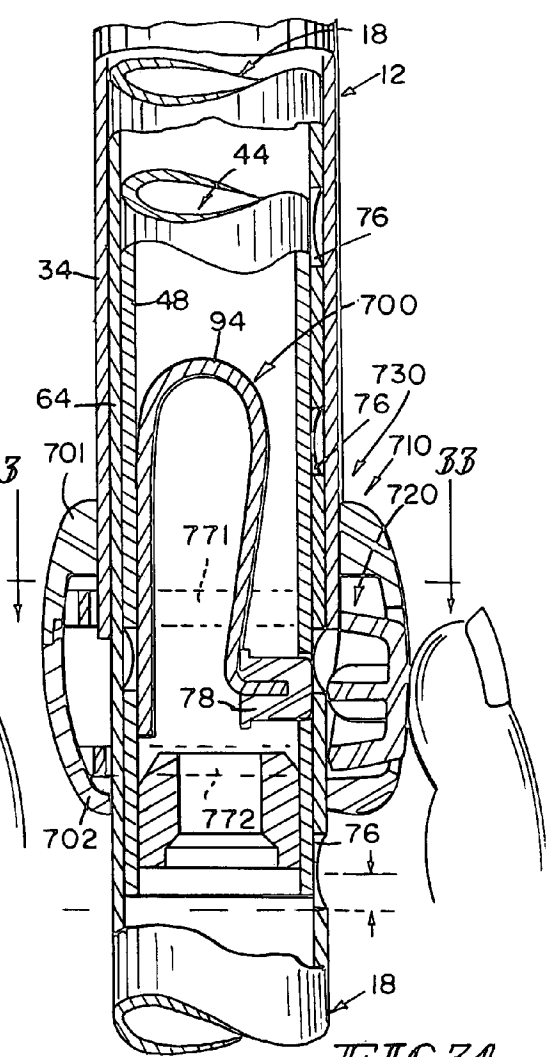
Figure 30:
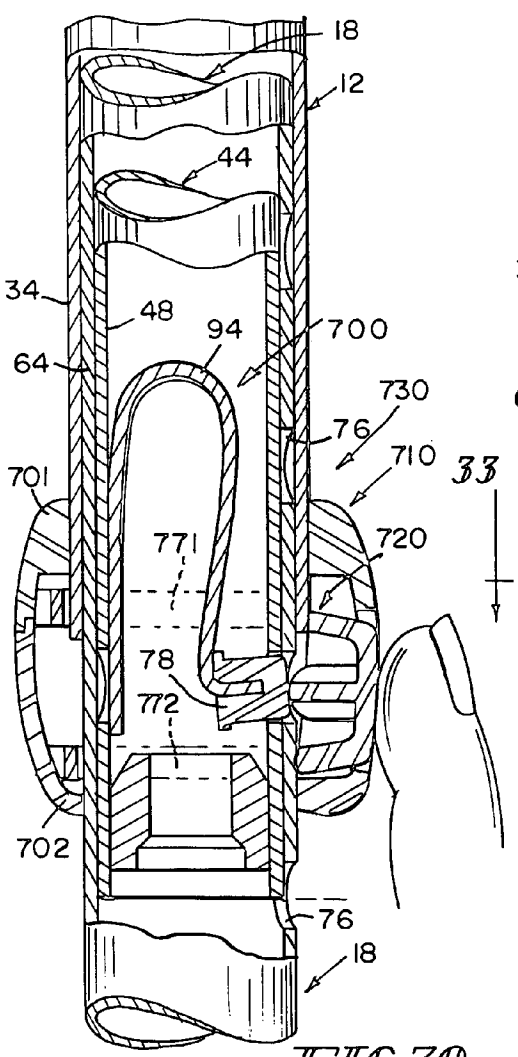

In the illustrated embodiment, means 770 includes upper and lower straps 771, 772 coupled to interior side 721 of finger plate 726 as shown, for example, in FIGS. 27 and 28. Each strap 771, 772 is sized and shaped to provide return means for acting against an interior wall of lower end cap 710 normally to return finger pad 726 to a "ready" position shown in FIGS. 29 and 32 after it is depressed as shown in FIGS. 30 and 31 and then released. Stand-offs 773 are appended to outer surfaces of straps 771, 772 and arranged to engage an interior wall of lower end cap 710 as suggested in FIGS. 27-33 to cause side portions of straps 771, 772 to bow outwardly in a manner suggested in FIG. 23 to generate a return spring force that is applied to finger pad 726 and cause finger pad 26 to return to the ready position described herein.

The invention claimed is:

1. A walker comprising a walker frame including upright first and second sleeves and a stretcher arranged to interconnect the first and second sleeves to maintain the sleeves in spaced-apart relation to one another first and second frame supports coupled to the walker frame to support the walker frame in an elevated position above ground underlying the walker frame, the first frame support extends through a first support receiver channel formed in the first sleeve, the second frame support extends through a second support receiver channel formed in the second sleeve, the first frame support including a first arm supported on the upright first sleeve for rotation about an axis of rotation between a storage position alongside the stretcher and a use position at a selected angle to the stretcher and arranged to extend away from the first sleeve to provide a grip portion adapted to be gripped by a first hand of a user, the first frame support further including a first leg coupled to the first arm to rotate therewith relative to the first sleeve about the axis of rotation and extend below the first sleeve and adapted to engage ground underlying the walker frame and wherein the first arm further includes anti-rotation means for engaging the first sleeve upon movement of the first arm to the use position to block rotation of the first arm relative to the first sleeve.

2. The walker of claim 1, wherein the first sleeve is formed to include a pin guide slot and the first arm includes a mount portion extending into the first support receiver channel and an anchor pin coupled to the mount portion and arranged to extend into the pin guide slot for movement therein during rotation of the first arm relative to the first sleeve about the axis of rotation to block removal of the mount portion from the first support receiver channel.

3. The walker of claim 2, wherein one end of the pin guide slot defines a closed-position stop arranged to engage the anchor pin upon rotation of the first arm about the axis of rotation in a first rotary direction to assume the storage position to block further rotation of the first arm in the first rotary direction and an opposite end of the pin guide slot defines an opened-position stop arranged to engage the anchor pin upon rotation of the first arm about the axis of rotation in a second rotary direction opposite to the first rotary direction to assume the use position to block further rotation of the first arm in the second rotary direction.

4. The walker of claim 3, wherein a border providing an edge of the pin guide slot extends between the closed-position stop and the opened-position slot to define an arc subtending a central angle of about 90° having a vertex along the axis of rotation.

5. The walker of claim 2, wherein the first sleeve includes an upper end defining an opening into the first support receiver channel, the stretcher lies in spaced-apart relation to the upper end of the first sleeve, and the pin guide slot is formed in the first sleeve to lie between the upper end and the stretcher.

6. The walker of claim 1, wherein the anti-rotation means is located in the first support receiver channel.

7. The walker of claim 1, wherein the walker frame further includes actuator means for moving the anti-rotation means to disengage the first sleeve when the first arm is rotated to assume the use position so that the first arm is free to rotate relative to the first sleeve about the axis of rotation toward the storage position.

8. The walker of claim 1, wherein the first arm includes a mount portion extending into the first support receiver channel and an anti-rotation lock coupled to the mount portion and configured to move relative to the first sleeve between a locked position blocking rotation of the first arm relative to the first sleeve about the axis of rotation upon arrival of the first arm at the use position and an unlocked position allowing rotation of the first arm relative to the first sleeve about the axis of rotation and wherein the walker frame includes a lock actuator including a button mount coupled to the first sleeve and an actuator button mounted on the button mount for movement to intercept and move the anti-rotation lock from the locked position to the unlocked position to free the first arm for rotation relative to the first sleeve about the axis of rotation.

9. The walker of claim 1, wherein the first arm is received in and is coupled to the first leg in extensible, telescoping relation, the first leg is formed to include a lock pin-receiving aperture, the first arm is formed to include a lower pin hole, and the first frame support further includes a lock pin mounted for movement in the lower pin hole between an extended position projecting into the lock pin-receiving aperture and the lower pin hole to link the first arm to the first leg to block telescoping movement of the first leg relative to the walker frame and the first arm along the axis of rotation and a retracted position outside of the lock pin-receiving aperture formed in the first leg to allow telescoping movement of the first leg relative to the walker frame and the first arm along the axis of rotation.

10. A walker comprising a walker frame including upright first and second sleeves and a stretcher arranged to interconnect the first and second sleeves to maintain the sleeves in spaced-apart relation to one another and first and second frame supports coupled to the walker frame to support the walker frame in an elevated position above ground underlying the walker frame, the first frame support extends through a first support receiver channel formed in the first sleeve, the second frame support extends through a second support receiver channel formed in the second sleeve, the first frame support including a first arm supported on the upright first sleeve for rotation about an axis of rotation between a storage position alongside the stretcher and a use position at a selected angle to the stretcher and arranged to extend away from the first sleeve to provide a grip portion adapted to be gripped by a first hand of a user, the first frame support further including a first leg coupled to the first arm to rotate therewith relative to the first sleeve about the axis of rotation and extend below the first sleeve and adapted to engage ground underlying the walker frame, wherein the first sleeve is formed to include a pin guide slot and the first arm includes a mount portion extending into the first support receiver channel and an anchor pin coupled to the mount portion and arranged to extend into the pin guide slot for movement therein during rotation of the first arm relative to the first sleeve about the axis of rotation to block removal of the mount portion from the first support receiver channel, wherein one end of the pin guide slot defines a closed-position stop arranged to engage the anchor pin upon rotation of the first arm about the axis of rotation in a first rotary direction to assume the storage position to block further rotation of the first arm in the first rotary direction and an opposite end of the pin guide slot defines an opened-position stop arranged to engage the anchor pin upon rotation of the first arm about the axis of rotation in a second rotary direction opposite to the first rotary direction to assume the use position to block further rotation of the first arm in the second rotary direction, and wherein the walker frame further includes an upper end cap coupled to an upper end of the first sleeve and the upper end cap includes a top wall formed to include an arm receiver aperture receiving the mount portion therein and a skirt depending from the top wall to locate a portion of the upper end of the first sleeve providing the pin guide slot between the skirt and the mount portion.

11. A walker comprising a walker frame including upright first and second sleeves and a stretcher arranged to interconnect the first and second sleeves to maintain the sleeves in spaced-apart relation to one another and first and second frame supports coupled to the walker frame to support the walker frame in an elevated position above ground underlying the walker frame, the first frame support extends through a first support receiver channel formed in the first sleeve, the second frame support extends through a second support receiver channel formed in the second sleeve, the first frame support including a first arm supported on the upright first sleeve for rotation about an axis of rotation between a storage position alongside the stretcher and a use position at a selected angle to the stretcher and arranged to extend away from the first sleeve to provide a grip portion adapted to be gripped by a first hand of a user, the first frame support further including a first leg coupled to the first arm to rotate therewith relative to the first sleeve about the axis of rotation and extend below the first sleeve and adapted to engage ground underlying the walker frame, wherein the first sleeve is formed to include a pin guide slot and the first arm includes a mount portion extending into the first support receiver channel and an anchor pin coupled to the mount portion and arranged to extend into the pin guide slot for movement therein during rotation of the first arm relative to the first sleeve about the axis of rotation to block removal of the mount portion from the first support receiver channel, wherein the first sleeve includes an upper end defining an opening into the first support receiver channel, the stretcher lies in spaced-apart relation to the upper end of the first sleeve, and the pin guide slot is formed in the first sleeve to lie between the upper end and the stretcher, and wherein the walker frame further includes an upper end cap coupled to the upper end of the first sleeve and the upper end cap includes a top wall formed to include an arm receiver aperture receiving a portion of the arm therein and a skirt depending from the top wall and covering the pin guide slot and the anchor pin extending into the pin guide slot.

12. A walker comprising a walker frame including upright first and second sleeves and a stretcher arranged to interconnect the first and second sleeves to maintain the sleeves in spaced-apart relation to one another and first and second frame supports coupled to the walker frame to support the walker frame in an elevated position above ground underlying the walker frame, the first frame support extends through a first support receiver channel formed in the first sleeve, the second frame support extends through a second support receiver channel formed in the second sleeve, the first frame support including a first arm supported on the upright first sleeve for rotation about an axis of rotation between a storage position alongside the stretcher and a use position at a selected angle to the stretcher and arranged to extend away from the first sleeve to provide a grip portion adapted to be gripped by a first hand of a user, the first frame support further including a first leg coupled to the first arm to rotate therewith relative to the first sleeve about the axis of rotation and extend below the first sleeve and adapted to engage ground underlying the walker frame, wherein the first sleeve is formed to include a pin guide slot and the first arm includes a mount portion extending into the first support receiver channel and an anchor pin coupled to the mount portion and arranged to extend into the pin guide slot for movement therein during rotation of the first arm relative to the first sleeve about the axis of rotation to block removal of the mount portion from the first support receiver channel, and wherein the first sleeve is also formed to include a pin-receiving aperture, the first arm is formed to include an upper pin hole, and the first frame support further includes an anti-rotation pin mounted for movement in the upper pin hole between an extended position projecting into the pin-receiving aperture and the upper pin hole to link the first arm to the first sleeve to block rotation of the first arm relative to the first sleeve about the axis of rotation and a retracted position outside of the pin-receiving aperture formed in the first sleeve to allow rotation of the first arm relative to the first sleeve about the axis of rotation.

13. The walker of claim 12, wherein the first frame support further includes a pin-biasing spring associated with the first arm and arranged to urge the anti-rotation pin to the extended position upon alignment of the upper pin hole of the first arm in confronting relation to the pin-receiving aperture of the first sleeve.

14. The walker of claim 13, wherein the first frame support further includes means coupled to the first sleeve for moving the anti-rotation pin against the pin-biasing spring from the extended position to the retracted position so that the first arm is free to rotate relative to the first sleeve about the axis of rotation.

15. The walker of claim 12, wherein the walker frame further includes an upper end cap coupled to an upper end of the first sleeve and an actuator button mounted for pivotable movement about a pivot axis on the upper end cap and arranged to pivot about the pivot axis to intercept the anti-rotation pin and move the anti-rotation pin to disengage the pin-receiving aperture formed in the first sleeve.

16. The walker of claim 12, wherein the pin guide slot is formed in the first sleeve to lie between the upper end and the pin-receiving aperture.

17. A walker comprising a walker frame including upright first and second sleeves and a stretcher arranged to interconnect the first and second sleeves to maintain the sleeves in spaced-apart relation to one another first and second frame supports coupled to the walker frame to support the walker frame in an elevated position above ground underlying the walker frame, the first frame support extends through a first support receiver channel formed in the first sleeve, the second frame support extends through a second support receiver channel formed in the second sleeve, the first frame support including a first arm supported on the upright first sleeve for rotation about an axis of rotation between a storage position alongside the stretcher and a use position at a selected angle to the stretcher and arranged to extend away from the first sleeve to provide a grip portion adapted to be gripped by a first hand of a user, the first frame support further including a first leg coupled to the first arm to rotate therewith relative to the first sleeve about the axis of rotation and extend below the first sleeve and adapted to engage ground underlying the walker frame wherein the first sleeve is also formed to include a pin-receiving aperture, the first arm is formed to include an upper pin hole, and the first frame support further includes an anti-rotation pin mounted for movement in the upper pin hole between an extended position projecting into the pin-receiving aperture and the upper pin hole to link the first arm to the first sleeve to block rotation of the first arm relative to the first sleeve about the axis of rotation and a retracted position outside of the pin-receiving aperture formed in the first sleeve to allow rotation of the first arm relative to the first sleeve about the axis of rotation, with the movement of the anti-rotation pin being generally perpendicular to the axis of rotation.

18. The walker of claim 17, wherein the first frame support further includes a pin-biasing spring associated with the first arm and arranged to urge the anti-rotation pin normally to the extended position upon alignment of the upper pin hole of the first arm in confronting relation to the pin-receiving aperture of the first sleeve.

19. The walker of claim 18, wherein the first arm includes a tubular mount portion formed to include an interior region communicating with the upper pin hole and wherein the pin-biasing spring is located in the interior region and coupled to the anti-rotation pin.

20. The walker of claim 18, wherein the first frame support further includes means coupled to the first sleeve for moving the anti-rotation pin against the pin-biasing spring from the extended position to the retracted position so that the first arm is free to rotate relative to the first sleeve about the axis of rotation.

21. A walker comprising a walker frame including upright first and second sleeves and a stretcher arranged to interconnect the first and second sleeves to maintain the sleeves in spaced-apart relation to one another and first and second frame supports coupled to the walker frame to support the walker frame in an elevated position above ground underlying the walker frame, the first frame support extends through a first support receiver channel formed in the first sleeve, the second frame support extends through a second support receiver channel formed in the second sleeve, the first frame support including a first arm supported on the upright first sleeve for rotation about an axis of rotation between a storage position alongside the stretcher and a use position at a selected angle to the stretcher and arranged to extend away from the first sleeve to provide a grip portion adapted to be gripped by a first hand of a user, the first frame support further including a first leg coupled to the first arm to rotate therewith relative to the first sleeve about the axis of rotation and extend below the first sleeve and adapted to engage ground underlying the walker frame, wherein the first sleeve is also formed to include a pin-receiving aperture, the first arm is formed to include an upper pin hole, and the first frame support further includes an anti-rotation pin mounted for movement in the upper pin hole between an extended position projecting into the pin-receiving aperture and the upper pin hole to link the first arm to the first sleeve to block rotation of the first arm relative to the first sleeve about the axis of rotation and a retracted position outside of the pin-receiving aperture formed in the first sleeve to allow rotation of the first arm relative to the first sleeve about the axis of rotation, wherein the first frame support further includes a pin-biasing spring associated with the first arm and arranged to urge the anti-rotation pin normally to the extended position upon alignment of the upper pin hole of the first arm in confronting relation to the pin-receiving aperture of the first sleeve, and wherein the walker frame further includes an upper end cap coupled to an upper end of the first sleeve and an actuator button mounted for pivotable movement about a pivot axis on the upper end cap and arranged to pivot about the pivot axis to intercept the anti-rotation pin and move the anti-rotation pin to disengage the pin-receiving aperture formed in the first sleeve.

22. A walker comprising a walker frame including upright first and second sleeves and a stretcher arranged to interconnect the first and second sleeves to maintain the sleeves in spaced-apart relation to one another and first and second frame supports coupled to the walker frame to support the walker frame in an elevated position above ground underlying the walker frame, the first frame support extends through a first support receiver channel formed in the first sleeve, the second frame support extends through a second support receiver channel formed in the second sleeve, the first frame support including a first arm supported on the upright first sleeve for rotation about an axis of rotation between a storage position alongside the stretcher and a use position at a selected angle to the stretcher and arranged to extend away from the first sleeve to provide a grip portion adapted to be gripped by a first hand of a user, the first frame support further including a first leg coupled to the first arm to rotate therewith relative to the first sleeve about the axis of rotation and extend below the first sleeve and adapted to engage ground underlying the walker frame, wherein the first arm is received in and is coupled to the first leg in extensible, telescoping relation, the first leg is formed to include a lock pin-receiving aperture, the first arm is formed to include a lower pin hole, and the first frame support further includes a lock pin mounted for movement in the lower pin hole between an extended position projecting into the lock pin-receiving aperture and the lower pin hole to link the first arm to the first leg to block telescoping movement of the first leg relative to the walker frame and the first arm along the axis of rotation and a retracted position outside of the lock pin-receiving aperture formed in the first leg to allow telescoping movement of the first leg relative to the walker frame and the first arm along the axis of rotation, and wherein the walker frame includes a lock actuator including a button mount coupled to the first sleeve and an actuator button mounted on the button mount for movement to intercept and move the lock pin from the extended position to the retracted position to free the first leg for telescoping movement relative to the walker frame and the first arm along the axis of rotation.

23. The walker of claim 22, wherein the first frame support further includes a pin-biasing spring associated with the first arm and arranged to urge the lock pin normally to the extended position upon alignment of the lower pin hole of the first arm in confronting relation to the lock pin-receiving aperture of the first leg.

24. A walker comprising a walker frame including upright first and second sleeves and a stretcher arranged to interconnect the first and second sleeves to maintain the sleeves in spaced-apart relation to one another, each sleeve including upper and lower ends, the first sleeve including a first channel extending from an opening in the upper end of the first sleeve to an opening in the lower end of the first sleeve, the second sleeve including a second channel extending from an opening in the upper end of the second sleeve to an opening in the lower end of the second sleeve, a first frame support including a first arm and a first leg, the first arm being separate from the first leg, the first arm including a first mount portion extending into the first channel through the opening in the upper end of the first sleeve, a first handle portion coupled to the first mount portion to move therewith and arranged to lie outside of the first channel, and a first anchor coupled to the first mount portion and arranged to engage the first sleeve to support the first mount portion for rotation relative to the first sleeve about a first axis of rotation between a storage position and a use position, the first leg including a first post extending into the first channel through the opening in the lower end of the first sleeve to mate with a lower end of the first mount portion and a first post foundation coupled to the first post to move therewith and adapted to engage ground underlying the walker frame, and a second frame support including a second arm and a second leg, the second arm including a second mount portion extending into the second channel through the opening in the upper end of the second sleeve, a second handle portion coupled to the second mount portion to move therewith and arranged to lie outside of the second channel, and a second anchor coupled to the second mount portion and arranged to engage the second sleeve to support the second mount portion for rotation relative to the second sleeve about a second axis of rotation between a storage position and a use position, the second leg including a second post extending into the second channel through the opening in the lower end of the second sleeve to mate with a lower end of the second mount portion and a second post foundation coupled to the second post to move therewith and adapted to engage ground underlying the walker frame.

25. The walker of claim 24, wherein the stretcher is an elongated tubular member having a first end coupled to the first sleeve and an opposite second end coupled to the second sleeve.

26. The walker of claim 25, wherein the walker frame is H-shaped.

27. The walker of claim 26, wherein each arm is L-shaped and each leg is Y-shaped.

28. The walker of claim 24, wherein the first arm is L-shaped and includes a first handle portion and a first elbow interconnecting the first handle portion and the first mount portion, the second arm is L-shaped and includes a second handle portion and a second elbow interconnecting the second handle portion and the second mount portion, and the first and second handle portions are arranged to lie in laterally spaced-apart relation to one another when the first and second mount portions are rotated to assume the use positions and are arranged to lie in end-to-end relation to one another in a space bounded by the stretcher and the first and second axes of rotation when the first and second mount portions are rotated to assume the storage positions.

29. The walker of claim 24, wherein the first post foundation includes a first leg elbow coupled to the first post, a first base having an upper portion coupled to the first leg elbow and a lower portion adapted to engage ground underlying the walker frame, and a first post stabilizer having an upper portion coupled to the first base and a lower portion adapted to engage ground underlying the walker frame, and wherein the second post foundation includes a second leg elbow coupled to the second post, a second base having an upper portion coupled to the second leg elbow and a lower portion adapted to engage ground underlying the walker frame, and a second post stabilizer having an upper portion coupled to the second base and a lower portion adapted to engage ground underlying the walker frame.

30. The walker of claim 29, wherein the first post stabilizer is arranged to underlie the first post and the second post stabilizer is arranged to underlie the second post.

31. The walker of claim 24, wherein the first sleeve includes an upper portion located above a junction between the first sleeve and the stretcher and formed to include a first slot, the first anchor extends into and moves in the first slot to support the first mount portion for rotation relative to the first sleeve about the first axis of rotation, the second sleeve includes an upper portion located above a junction between the second sleeve and the stretcher and formed to include a second slot, and the second anchor extends into and moves in the second slot to support the second mount portion for rotation relative to the second sleeve about the second axis of rotation.

32. The walker of claim 31, wherein the first sleeve includes a lower portion located below a junction between the first sleeve and the stretcher and formed to include a first interior region therein, the first mount portion extends downwardly through the first interior region, the first leg extends upwardly into the first interior region to mate with the first mount portion in extensible, telescoping relation, the first leg is formed to include a first lock pin-receiving aperture located outside of the first interior region, the first arm is formed to include a first lower pin hole, the first frame support further includes a first lock pin mounted for movement in the first lower pin hole between an extended position projecting into the first lock pin-receiving aperture and the first lower pin hole to link the first arm to the first leg so as to block telescoping movement of the first leg relative to the first walker frame and the first arm along the first axis of rotation and a retracted position outside of the first lock pin-receiving aperture formed in the first leg so as to allow telescoping movement of the first leg relative to the walker frame and the first arm along the first axis of rotation, the second sleeve includes a lower portion located below a junction between the second sleeve and the stretcher and formed to include a second interior region therein, the second mount portion extends downwardly through the second interior region, the second leg extends upwardly into the second interior region to the mate with the second mount portion in extensible, telescoping relation, the second leg is formed to include a second lock pin-receiving aperture located outside of the second interior region, the second arm is formed to include a second lower pin hole, the second frame support further includes a second lock pin mounted for movement in the second lower pin hole between an extended position projecting into the second lock pin-receiving aperture and the second lower pin hole to link the second arm to the second leg so as to block telescoping movement of the second leg relative to the walker frame and the second arm along the second axis of rotation and a retracted position outside of the second lock pin-receiving aperture formed in the second leg so as to allow telescoping movement of the second leg relative to the walker frame and the second arm along the second axis of rotation.

33. A walker comprising a walker frame including upright first and second sleeves and a stretcher arranged to interconnect the first and second sleeves to maintain the sleeves in spaced-apart relation to one another, each sleeve including upper and lower ends, the first sleeve including a first channel extending from an opening in the upper end of the first sleeve to an opening in the lower end of the first sleeve, the second sleeve including a second channel extending from an opening in the upper end of the second sleeve to an opening in the lower end of the second sleeve, a first frame support including a first arm and a first leg, the first arm including a first mount portion extending into the first channel through the opening in the upper end of the first sleeve, a first handle portion coupled to the first mount portion to move therewith and arranged to lie outside of the first channel, and a first anchor coupled to the first mount portion and arranged to engage the first sleeve to support the first mount portion for rotation relative to the first sleeve about a first axis of rotation between a storage position and a use position, the first leg including a first post extending into the first channel through the opening in the lower end of the first sleeve to mate with a lower end of the first mount portion and a first post foundation coupled to the first post to move therewith and adapted to engage ground underlying the walker frame, and a second frame support including a second arm and a second leg, the second arm including a second mount portion extending into the second channel through the opening in the upper end of the second sleeve, a second handle portion coupled to the second mount portion to move therewith and arranged to lie outside of the second channel, and a second anchor coupled to the second mount portion and arranged to engage the second sleeve to support the second mount portion for rotation relative to the second sleeve about a second axis of rotation between a storage position and a use position, the second leg including a second post extending into the second channel through the opening in the lower end of the second sleeve to mate with a lower end of the second mount portion and a second post foundation coupled to the second post to move therewith and adapted to engage ground underlying the walker frame, wherein the first arm is L-shaped and includes a first handle portion and a first elbow interconnecting the first handle portion and the first mount portion, the second arm is L-shaped and includes a second handle portion and a second elbow interconnecting the second handle portion and the second mount portion, and the first and second handle portions are arranged to lie in laterally spaced-apart relation to one another when the first and second mount portions are rotated to assume the use positions and are arranged to lie in end-to-end relation to one another in a space bounded by the stretcher and the first and second axes of rotation when the first and second mount portions are rotated to assume the storage positions, and wherein the first post foundation includes a first inverted V-shaped member comprising a first base and a first post stabilizer and also includes a first leg elbow interconnecting the first base and the first post, the second post foundation includes a second inverted V-shaped member comprising a second base and a second post stabilizer and also includes a second leg elbow interconnecting the second base and the second post, and the first and second V-shaped members are arranged to lie in spaced-apart relation to one another when the first and second mount portions are rotated to assume the use positions and are arranged to lie in side-by-side overlapping position to cause the first and second bases to cross and lie in a space below the stretcher between the first and second post stabilizers when the first and second mount portions are rotated to assume the storage positions.

34. A walker comprising a walker frame including upright first and second sleeves and a stretcher arranged to interconnect the first and second sleeves to maintain the sleeves in spaced-apart relation to one another, each sleeve including upper and lower ends, the first sleeve including a first channel extending from an opening in the upper end of the first sleeve to an opening in the lower end of the first sleeve, the second sleeve including a second channel extending from an opening in the upper end of the second sleeve to an opening in the lower end of the second sleeve, a first frame support including a first arm and a first leg, the first arm including a first mount portion extending into the first channel through the opening in the upper end of the first sleeve, a first handle portion coupled to the first mount portion to move therewith and arranged to lie outside of the first channel, and a first anchor coupled to the first mount portion and arranged to engage the first sleeve to support the first mount portion for rotation relative to the first sleeve about a first axis of rotation between a storage position and a use position, the first leg including a first post extending into the first channel through the opening in the lower end of the first sleeve to mate with a lower end of the first mount portion and a first post foundation coupled to the first post to move therewith and adapted to engage ground underlying the walker frame, and a second frame support including a second arm and a second leg, the second arm including a second mount portion extending into the second channel through the opening in the upper end of the second sleeve, a second handle portion coupled to the second mount portion to move therewith and arranged to lie outside of the second channel, and a second anchor coupled to the second mount portion and arranged to engage the second sleeve to support the second mount portion for rotation relative to the second sleeve about a second axis of rotation between a storage position and a use position, the second leg including a second post extending into the second channel through the opening in the lower end of the second sleeve to mate with a lower end of the second mount portion and a second post foundation coupled to the second post to move therewith and adapted to engage ground underlying the walker frame, wherein the first post foundation includes a first inverted V-shaped member comprising a first base and a first post stabilizer and also includes a first leg elbow interconnecting the first base and the first post, the second post foundation includes a second inverted V-shaped member comprising a second base and a second post stabilizer and also includes a second leg elbow interconnecting the second base and the second post, and the first and second V-shaped members are arranged to lie in spaced-apart relation to one another when the first and second mount portions are rotated to assume the use positions and are arranged to lie in side-by-side overlapping position to cause the first and second bases to cross and lie in a space below the stretcher between the first and second post stabilizers when the first and second mount portions are rotated to assume the storage positions.

35. The walker of claim 34, wherein the stretcher is an elongated tubular member having a first end coupled to the first sleeve and an opposite second end coupled to the second sleeve.

36. A walker comprising a walker frame including upright first and second sleeves and a stretcher arranged to interconnect the first and second sleeves to maintain the sleeves in spaced-apart relation to one another, each sleeve including upper and lower ends, the first sleeve including a first channel extending from an opening in the upper end of the first sleeve to an opening in the lower end of the first sleeve, the second sleeve including a second channel extending from an opening in the upper end of the second sleeve to an opening in the lower end of the second sleeve, a first frame support including a first arm and a first leg, the first arm including a first mount portion extending into the first channel through the opening in the upper end of the first sleeve, a first handle portion coupled to the first mount portion to move therewith and arranged to lie outside of the first channel, and a first anchor coupled to the first mount portion and arranged to engage the first sleeve to support the first mount portion for rotation relative to the first sleeve about a first axis of rotation between a storage position and a use position, the first leg including a first post extending into the first channel through the opening in the lower end of the first sleeve to mate with a lower end of the first mount portion and a first post foundation coupled to the first post to move therewith and adapted to engage ground underlying the walker frame, and a second frame support including a second arm and a second leg, the second aim including a second mount portion extending into the second channel through the opening in the upper end of the second sleeve, a second handle portion coupled to the second mount portion to move therewith and arranged to lie outside of the second channel, and a second anchor coupled to the second mount portion and arranged to engage the second sleeve to support the second mount portion for rotation relative to the second sleeve about a second axis of rotation between a storage position and a use position, the second leg including a second post extending into the second channel through the opening in the lower end of the second sleeve to mate with a lower end of the second mount portion and a second post foundation coupled to the second post to move therewith and adapted to engage ground underlying the walker frame, wherein the first sleeve includes an upper portion located above a junction between the first sleeve and the stretcher and formed to include a first slot, the first anchor extends into and moves in the first slot to support the first mount portion for rotation relative to the first sleeve about the first axis of rotation, the second sleeve includes an upper portion located above a junction between the second sleeve and the stretcher and formed to include a second slot, and the second anchor extends into and moves in the second slot to support the second mount portion for rotation relative to the second sleeve about the second axis of rotation, and wherein the upper portion of the first sleeve is formed to include a first pin-receiving aperture, the first mount portion is formed to include a first upper hole, the first frame support further includes a first anti-rotation pin mounted for movement in the first upper pin hole between an extended position projecting into the first pin-receiving aperture and the first upper pin hole to link the first arm to the first sleeve so as to block rotation of the first arm relative to the first sleeve about the first axis of rotation and a first pin-biasing spring associated with the first arm and arranged to urge the first anti-rotation pin to the extended position upon alignment of the first upper pin hole in confronting relation to the first pin-receiving aperture, the upper portion of the second sleeve is formed to include a second pin-receiving aperture, the second mount portion is formed to include a second upper pin hole, and the second frame support further includes a second anti-rotation pin mounted for movement in the second upper pin hole between an extended position projecting into the second pin-receiving aperture and the second upper pin hole to link the second arm to the second sleeve so as to block rotation of the second arm relative to the second sleeve about the second axis of rotation and a second pin-biasing spring associated with the second arm and arranged to urge the second anti-rotation pin to the extended position upon alignment of the second upper pin hole in confronting relation to the second pin-receiving aperture.

37. The walker of claim 36, wherein the walker frame further includes a first button mount coupled to the upper portion of the first sleeve and a first actuator button mounted for movement on the first button mount to intercept the first anti-rotation pin and move the first anti-rotation pin to disengage the first pin-receiving aperture formed in the first sleeve to free the first arm and first leg for rotation relative to the first sleeve about the first axis of rotation and the walker frame further includes a second button mount coupled to the upper portion of the second sleeve and a second actuator button mounted for movement on the second button mount to intercept the second anti-rotation pin and move the second anti-rotation pin to disengage the second pin-receiving aperture formed in the second sleeve to free the second arm and second leg for rotation relative to the second sleeve about the second axis of rotation.

38. The walker of claim 37, wherein the first actuator button is mounted on the first button mount to pivot about a first pivot axis and the second actuator button is mounted on the second button mount to pivot about a second pivot axis.

39. A walker comprising a walker frame including upright first and second sleeves and a stretcher arranged to interconnect the first and second sleeves to maintain the sleeves in spaced-apart relation to one another, each sleeve including upper and lower ends, the first sleeve including a first channel extending from an opening in the upper end of the first sleeve to an opening in the lower end of the first sleeve, the second sleeve including a second channel extending from an opening in the upper end of the second sleeve to an opening in the lower end of the second sleeve, a first frame support including a first arm and a first leg, the first arm including a first mount portion extending into the first channel through the opening in the upper end of the first sleeve, a first handle portion coupled to the first mount portion to move therewith and arranged to lie outside of the first channel, and a first anchor coupled to the first mount portion and arranged to engage the first sleeve to support the first mount portion for rotation relative to the first sleeve about a first axis of rotation between a storage position and a use position, the first leg including a first post extending into the first channel through the opening in the lower end of the first sleeve to mate with a lower end of the first mount portion and a first post foundation coupled to the first post to move therewith and adapted to engage ground underlying the walker frame, and a second frame support including a second arm and a second leg, the second arm including a second mount portion extending into the second channel through the opening in the upper end of the second sleeve, a second handle portion coupled to the second mount portion to move therewith and arranged to lie outside of the second channel, and a second anchor coupled to the second mount portion and arranged to engage the second sleeve to support the second mount portion for rotation relative to the second sleeve about a second axis of rotation between a storage position and a use position, the second leg including a second post extending into the second channel through the opening in the lower end of the second sleeve to mate with a lower end of the second mount portion and a second post foundation coupled to the second post to move therewith and adapted to engage ground underlying the walker frame, wherein the first sleeve includes an upper portion located above a junction between the first sleeve and the stretcher and formed to include a first slot, the first anchor extends into and moves in the first slot to support the first mount portion for rotation relative to the first sleeve about the first axis of rotation, the second sleeve includes an upper portion located above a junction between the second sleeve and the stretcher and formed to include a second slot, and the second anchor extends into and moves in the second slot to support the second mount portion for rotation relative to the second sleeve about the second axis of rotation, wherein the first sleeve includes a lower portion located below a junction between the first sleeve and the stretcher and formed to include a first interior region therein, the first mount portion extends downwardly through the first interior region, the first leg extends upwardly into the first interior region to mate with the first mount portion in extensible, telescoping relation, the first leg is formed to include a first lock pin-receiving aperture located outside of the first interior region, the first arm is formed to include a first lower pin hole, the first frame support further includes a first lock pin mounted for movement in the first lower pin hole between an extended position projecting into the first lock pin-receiving aperture and the first lower pin hole to link the first arm to the first leg so as to block telescoping movement of the first leg relative to the walker frame and the first arm along the first axis of rotation and a retracted position outside of the first lock pin-receiving aperture formed in the first leg so as to allow telescoping movement of the first leg relative to the walker frame and the first arm along the first axis of rotation, the second sleeve includes a lower portion located below a junction between the second sleeve and the stretcher and formed to include a second interior region therein, the second mount portion extends downwardly through the second interior region, the second leg extends upwardly into the second interior region to the mate with the second mount portion in extensible, telescoping relation, the second leg is formed to include a second lock pin-receiving aperture located outside of the second interior region, the second arm is formed to include a second lower pin hole, the second frame support further includes a second lock pin mounted for movement in the second lower pin hole between an extended position projecting into the second lock pin-receiving aperture and the second lower pin hole to link the second arm to the second leg so as to block telescoping movement of the second leg relative to the walker frame and the second arm along the second axis of rotation and a retracted position outside of the second lock pin-receiving aperture formed in the second leg so as to allow telescoping movement of the second leg relative to the walker frame and the second arm along the second axis of rotation, and wherein the first frame support includes a first pin-biasing spring associated with the first arm and arranged to urge the first lock pin normally to the extended position upon alignment of the first lower pin hole in confronting relation to the first lock pin-receiving aperture, the walker frame further includes a first lock actuator including a first button mount coupled to the lower portion of the first sleeve and a first actuator button mounted on the first button mount to intercept and move the first lock pin from the extended position to the retracted position to free the first leg for telescoping movement relative to the walker frame and the first arm along the first axis of rotation, the second frame support includes a second pin-biasing spring associated with the second arm and arranged to urge the second lock pin normally to the extended position upon alignment of the second lower pin hole in confronting relation to the second lock pin-receiving aperture, and the walker frame further includes a second lock actuator including a second button mount coupled to the lower portion of the second sleeve and a second actuator button mounted on the second button mount to intercept and move the second lock pin from the extended position to the retracted position to free the second leg for telescoping movement relative to the walker frame and the second arm along the second axis of rotation.

40. The walker of claim 39, wherein the upper portion of the first sleeve is formed to include a first pin-receiving aperture, the first mount portion is formed to include a first upper hole, the first frame support further includes a first anti-rotation pin mounted for movement in the first upper pin hole between an extended position projecting into the first pin-receiving aperture and the first upper pin hole to link the first arm to the first sleeve so as to block rotation of the first arm relative to the first sleeve about the first axis of rotation and a first pin-biasing spring associated with the first arm and arranged to urge the first anti-rotation pin to the extended position upon alignment of the first upper pin hole in confronting relation to the first pin-receiving aperture, the upper portion of the second sleeve is formed to include a second pin-receiving aperture, the second mount portion is formed to include a second upper pin hole, and the second frame support further includes a second anti-rotation pin mounted for movement in the second upper pin hole between an extended position projecting into the second pin-receiving aperture and the second upper pin hole to link the second arm to the second sleeve so as to block rotation of the second arm relative to the second sleeve about the second axis of rotation and a second pin-biasing spring associated with the second arm and arranged to urge the second anti-rotation pin to the extended position upon alignment of the second upper pin hole in confronting relation to the second pin-receiving aperture.

41. A walker comprising a walker frame including first and second sleeves and a stretcher arranged to interconnect the first and second sleeves to maintain the sleeves in spaced-apart relation to one another, a first frame support including a first arm adapted to be gripped by a user and a first leg adapted to engage ground underlying the walker frame, the first frame support extending through a first channel formed in the first sleeve, a second frame support including a second arm adapted to be gripped by a user and a second leg adapted to engage ground underlying the walker frame, the second frame support extending through a second channel formed in the second sleeve wherein the first frame support further includes rotary means for supporting the first arm on the first sleeve for rotation about a first axis of rotation between a storage position and a user position, and wherein the first leg is arranged to extend into the first channel and mate with the first arm to slide relative to the first arm to vary elevation of the first arm above ground underlying the walker frame and the first frame support further includes height-adjustment means for selectively locking the first leg to the first arm in a selected one of several positions to establish an effective height of the first frame support without blocking rotation of the first arm relative to the first axis of rotation.

42. The walker of claim 41, wherein the first frame support further includes a first anchor coupled to the first arm and arranged to engage the first sleeve to support the first arm for rotation relative to the first sleeve about a first axis between a storage position and a user position, and an anti-rotation pin mounted for movement generally perpendicular to the axis of rotation between an extended position and a retracted position to block rotation of the first arm relative to the first sleeve about the axis of rotation and to allow rotation of the first arm relative to the first sleeve about the axis of rotation.

43. The walker of claim 42, wherein the first anchor is located in the first channel.

44. The walker of claim 42, wherein the first sleeve is formed to include a first pin guide slot and the first anchor is arranged to extend into the first pin guide slot for movement therein during rotation of the first arm relative to the first sleeve about the first axis of rotation to block removal of the first arm from the first channel.

45. The walker of claim 44, wherein one end of the first pin guide slot defines a closed-position stop arranged to engage the first anchor upon rotation of the first arm about the axis of rotation in a first rotary direction to assume the storage position to block further rotation of the first arm in the first rotary direction and an opposite end of the first pin guide slot defines an opened-position stop arranged to engage the first anchor upon rotation of the first arm about the axis of rotation in a second rotary direction opposite to the first rotary direction to assume the use position to block further rotation of the first arm in the second rotary direction.

* * * * *